US009493956B2

(12) United States Patent
Tilton

(10) Patent No.: US 9,493,956 B2
(45) **Date of Patent: *Nov. 15, 2016**

(54) CUSTOM COFFERED SURFACE LAYOUT, FABRICATION, AND INSTALLATION METHODS AND PROCESSES

(71) Applicant: Jason Tilton, Oyster Bay, NY (US)

(72) Inventor: Jason Tilton, Oyster Bay, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/529,441

(22) Filed: Oct. 31, 2014

(65) Prior Publication Data

US 2015/0082718 A1 Mar. 26, 2015

Related U.S. Application Data

(60) Continuation-in-part of application No. 13/783,177, filed on Mar. 1, 2013, now abandoned, which is a division of application No. 13/269,929, filed on Oct. 10, 2011, now Pat. No. 8,640,417.

(51) Int. Cl.
*E04F 13/07* (2006.01)
*E04F 13/00* (2006.01)
*E04F 19/00* (2006.01)

(52) U.S. Cl.
CPC ..... *E04F 13/07* (2013.01); *E04F 13/00* (2013.01); *E04F 19/00* (2013.01); *E04F 2203/00* (2013.01)

(58) Field of Classification Search
CPC ..... E04C 2/38; E04C 2/00; E04F 13/00; E04F 13/07; E04F 19/00; Y10T 29/49; Y10T 29/49629
USPC ..... 52/287.1, 288.1, 270, 272, 284, 506.06, 52/506.09, 506.1, 311.2
See application file for complete search history.

(56) References Cited

U.S. PATENT DOCUMENTS

| | | | | | |
|---|---|---|---|---|---|
| 450,274 | A | * | 4/1891 | Wilson | 52/461 |
| 985,367 | A | * | 2/1911 | Pitney | 52/313 |
| 3,828,506 | A | * | 8/1974 | Phillips | 52/506.07 |
| 4,189,888 | A | * | 2/1980 | Blitzer, Jr. | 52/506.07 |
| 4,452,021 | A | * | 6/1984 | Anderson | 52/506.07 |
| 4,722,161 | A | * | 2/1988 | Young | 52/506.07 |
| 4,736,559 | A | * | 4/1988 | Young | 52/313 |
| 4,926,606 | A | * | 5/1990 | Hanson | 52/506.07 |

(Continued)

FOREIGN PATENT DOCUMENTS

JP 01125447 A * 5/1989 ..... E04B 5/52

*Primary Examiner* — Brent W Herring
(74) *Attorney, Agent, or Firm* — Tran & Associates

(57) ABSTRACT

A coffer includes a panel; beam wall boards attached perpendicular to a first side of the panel and extending away from the panel and forming the side walls for a pattern of intersecting, non-structural hollow box beams, wherein the panel extends past the beam wall boards to create a fastening flange or point by which one or more modules are secured to a substrate; and a beam wall molding cut to size and custom-fitted to the beam wall boards and a panel after the beam wall boards have been attached to the panel, wherein the beam wall molding connects surfaces between the beam wall boards and the panel without covering the beam wall board edges and wherein the panel directly terminates into a perpendicular wall or surface or into the substrate and wherein the modules and resulting hollow box beams include polygonal and curved shapes and wherein the beam wall moldings follow the exact shape of the beam wall boards to eliminate spaces between the beam wall moldings and the beam wall board that would require filling by an additional board, part or component.

19 Claims, 40 Drawing Sheets

(56) References Cited

U.S. PATENT DOCUMENTS 5,433,048 A * 7/1995 Strasser ..... 52/288.1
5,884,444 A * 3/1999 Harris ..... 52/311.2
7,017,317 B2 * 3/2006 Capozzo ..... 52/506.07
8,028,481 B2 * 10/2011 Deschenes ..... 52/311.2
2010/0058692 A1 * 3/2010 Deschenes ..... 52/311.2
2013/0086863 A1 * 4/2013 Tilton ..... 52/588.1

* cited by examiner

CUSTOM COFFERED SURFACE LAYOUT, FABRICATION, AND INSTALLATION METHODS AND PROCESSES

This application is a continuation in part application of Ser. No. 13/783,177 filed Mar. 1, 2013, which is a divisional of Ser. No. 13/269,929 filed Oct. 10, 2011, the contents of which are incorporated by reference.

BACKGROUND OF THE INVENTION

The present system relates generally to a custom fitted and permanently applied decorative coffered surface.

DESCRIPTION OF RELATED ART

The intersecting grid of structural beams that made up the very first coffered ceilings were designed to help support heavy roof loads, but consequently they also added to the ceiling's architectural and visual appeal. Today's coffered ceilings are primarily installed as an aesthetic element and use a grid of intersecting, non-structural, typically hollow, box beams to replicate the desirable look and feel of their structural predecessors. The main purpose of the modern day coffered ceiling is to add decoration and appeal to an otherwise plain and unappealing surface. Likewise, a coffered detail of intersecting beams may also be applied to walls or any other form of horizontal, vertical, angled, straight or curved surfaces for the purpose of decoration and aesthetic enhancement.

One type of system that is used to mimic or resemble the look of a true coffered ceiling is to use a suspended ceiling grid and ceiling tile type application. These applications use standard sized, typically 2'×2' or 2'×4', removable tiles that rest on a suspended grid system of either standard or custom type T-bars, L-channels, tracks, and so on, which are hung from the substrate with suspension wires, screw hooks, etc. To achieve the appearance of a coffered ceiling the individual tiles are made with a deep recess to resemble coffers, but since these ceiling systems do not utilize any form of actual beams they are not considered to be true coffered ceilings and should not be confused with the real thing. They simply create a facade.

A typical decorative coffered ceiling constructed with hollow "box beams" can also offer a useful means for routing and/or hiding existing and/or new mechanical and/or structural items such as electrical wires, plumbing pipes, duct work, support headers etc. which can be routed inside of or covered over by the hollow box beams which are typically constructed to have only 3 sides.

Coffered ceilings have also been known to improve a room's acoustical performance and are often used for this purpose in theatres or in media rooms where sound quality is critical and aesthetic enhancements are desired.

The conventional methods for layout, fabrication and installation of a permanently installed decorative coffered ceiling include the use of raw molding and millwork materials that are custom fabricated, cut, assembled and fastened to the substrate by an onsite team of craftsmen and/or carpenters to achieve a proper fit and finish. These conventional, onsite custom fabrication methods have the following drawbacks:

1. All work must be performed under existing site conditions which significantly diminishes the quality of the custom fabrication.
2. They require a large onsite work space which often crowds and/or interferes with either the other tradesman/laborers, families, employees, customers and so on who may be working, living or conducting business at or on the same site. All of which may cause delays.
3. They require a wide variety of professional woodworking tools and equipment which need to be set-up onsite to create the coffered ceiling. This ultimately adds to the overall time and labor required to complete the coffered ceiling installation.
4. It requires the use of nailer blocks or boards to first be fastened or adhered to the substrate to which all of the beams are secured. This initial installation step requires additional materials and labor, which ultimately adds to the overall cost. Delays may also be caused in circumstances where the nailer blocks/boards run parallel to and cannot be directly fastened to the underlying substrate framework. In these instances adhesive and hollow wall anchors must be used to secure the nailer blocks/boards and be given adequate time to dry or set before moving forward with the installation of the beams.
5. The onsite custom fabrication process creates a significant mess, for example, the high volume of cutting and milling that is required of the materials, creates a substantial amount of dust, debris and waste. This can often crowd and/or interfere with the other tradesman/laborers, families, employees, customers and so on who may be working, living or conducting business at or on the same site. All of which may cause delays.
6. The substantial amount of dust, debris and waste creates the necessity for proper containment, especially on remodeling type residential or commercial projects, and results in a more extensive cleanup process. This ultimately adds to the overall time and labor required to complete the coffered ceiling installation.
7. The substantial amount of dust, debris and waste creates a safety hazard for both the installers of the coffered ceiling as well as for the other tradesman/laborers, families, employees, customers and so on who may be working, living or conducting business at or on the same site.
8. Onsite custom fabrication requires a high level of woodworking and mathematical skill on the part of the craftsman and/or carpenters who are performing the installation. This equates to higher labor wages for the higher skillset which ultimately adds to the overall cost of the coffered ceiling.
9. Onsite fabrication inherently takes a long time to complete. Typical ceilings take an average of about five days.

Adding to the complexity of onsite fabrication and installation of a coffered ceiling, is the circumstance of significant overhead work. This overhead work is performed on either ladders or scaffolding, which makes completion of the installation inherently more dangerous, challenging, frustrating, and time consuming.

Another significant issue that the conventional onsite fabrication and installation methods for a coffered ceiling do not address is that the surface of the substrate on which the coffered ceiling is installed, typically plaster or drywall, is rarely, if ever, perfectly smooth, flat, level, straight or free of defects such as holes cracks, chips, stains and so on. These imperfections and/or conditions lead to one of several common drawbacks and/or undesirable scenarios:

1. If the initial installation of the beams is performed in a manner as to keep them tight to an un-level, uneven, crooked or wavy substrate surface, with no regard for being level, straight or flat, the beams will ultimately reflect and magnify the surface imperfections. These will reveal themselves by making it very difficult to not only properly fit and join the beams to one another, but also to fit and join any and all additional components to the beams such as the beam moldings, detail moldings, ornamentation and the like. There will be difficulty in both the independent installation of these components as well as how they relate to and meet with each other at the intersecting points, miters, copes, joints and so on. This situation will ultimately yield unacceptable quality, and/or an aesthetically unappealing finished coffered ceiling.

2. If the initial installations of the beams are somehow shimmed and/or otherwise fastened to the an un-level, crooked, wavy, or otherwise imperfect, inconsistent substrate surface in a way that manages to achieve a level, straight and/or flat plane at the bottom of the beams, the issues will then reveal themselves in the inconsistency that is created in the distance between the bottom of the beams and the substrate surface. This inconsistency causes significant issues with the subsequent beam moldings, detail moldings, ornamentation and the like that are installed following the installation of the beams. These issues include:
   a. If the installer chooses to keep the molding tight to the substrate surface the reveal, or distance between the bottom of the beams and the bottom of the beam moldings, will not remain equal or consistent. In this instance the angles of the molding in the corners where the beams intersect will become inconsistent and therefore much more difficult to complete with neat and proper joints. This adds additional time and labor to the process while yielding less than perfect results. The inconsistent reveals between the moldings and the beams will also be quite noticeable when complete and will detract from the overall appearance of the finished coffered ceiling.
   b. If the installer chooses to keep the reveal between the bottom of the moldings and the bottom of the beams equal or constant, on all of the beams, then the top of the beam moldings will not remain tight to the substrate surface in all areas. This will create various sized gaps between the top of the beam moldings and the substrate surface. The gaps will then need to be filled either with custom sized strips of wood/material, with wood filler and or caulking. This will also add time, labor and cost to the process while yielding less than perfect results.
3. The substrate surface is not always fully covered when using conventional methods and therefore imperfections, such as holes, cracks, chips, stains and so on may still show or be seen after a coffered detail has been installed. In these circumstances the exposed portions of the substrate will more than likely require further attention after the coffered detail has been installed such as patching, plaster/spackling and so on. This will ultimately add time, labor and cost to the process.

Another prior art system that has been used to create a decorative coffered ceiling is the Classic Coffered Ceiling Kit offered by Curve Makers Inc. that uses prefabricated, two-piece crown assembly boxes as described by the company. While the boxes that make up these kits may appear somewhat similar to the coffer modules of the present system, they differ mainly due to their inability to address the ever present issues of an imperfect substrate just like all prior art. Likewise, the kit differs in its lack of customization options. The Curve Makers kit is essentially a one-style-fits-all product with the only customizable options being the length and width of the boxes.

For example, the Curve Makers kit does not include a fully integrated ceiling/surface panel. This significant omission and flaw in their design allows for the underlying substrate surface to show through the center of each crown assembly box. This design does not address the problems and/or the impact that an imperfect substrate surface has on the installation and/or the quality and aesthetic appearance of the finished product. While the crown assembly boxes of this kit maintain a constant reveal between the bottom of the beams and the bottom of the crown molding and while they can be shimmed and/or otherwise fastened to the imperfect substrate surface in a way that manages to achieve a level, straight and/or flat plane of the entire kit, the inconsistency issue still arises in the distance between the top of the boxes and/or crown molding and the substrate surface as described in the prior art previously outlined.

Additionally, the Curve Makers coffered ceiling kits only offer one type, style and depth of crown assembly boxes and they are only available in square or rectangular shapes. Furthermore, the kits are only available in solid hardwood materials which are inherently more expensive and more prone to twisting and warping than other modern woodworking material options that are available in today's market. All of these factors dramatically limit the design options and customization capabilities of the customer or end user.

The lack of viable fabrication, installation and pricing information that has been made available from Curve Makers for their ceiling kit, as well as the fact that it is not part of their primary business or product line, have frustrated potential purchasers. As of the date of this application, the kits appear to have been withdrawn from sales inquiries and removed from the company's website.

In addition, the use of the present system may have excellent potential for use on vertical or angled walls or surfaces. Regardless of the substrate surface type, the present system would utilize any form of woodworking materials such as solid wood, plywood, MDF, polyurethane, and so on.

A prefabricated coffered ceiling and surface system that overcomes the numerous problems associated with prior art would be valuable to this trade.

BRIEF SUMMARY OF THE INVENTION

A coffer includes a panel; beam wall boards attached perpendicular to a first side of the panel and extending away from the panel and forming the side walls for a pattern of intersecting, non-structural hollow box beams, wherein the panel extends past the beam wall boards to create a fastening flange or point by which one or more modules are secured to a substrate; and a beam wall molding cut to size and custom-fitted to the beam wall boards and a panel after the beam wall boards have been attached to the panel, wherein the beam wall molding connects surfaces between the beam wall boards and the panel without covering the beam wall board edges and wherein the panel directly terminates into a perpendicular wall or surface or into the a substrate and wherein the modules and resulting hollow box beams includes polygonal and curved shapes and wherein the beam wall moldings follow the exact shape of the beam wall boards to eliminate spaces between the beam wall moldings and the beam wall boards that would require filling by an additional board, part or component.

Implementations of the above aspect may include one or more of the following. The system is made up of several primary components, including, but not limited to, a ceiling/surface panel, beam wall boards, beam moldings (for example, crown molding or other decorative molding type), beam bottom boards and the perimeter molding. The components of the present system are prefabricated and may be preassembled to create individual coffer modules using a unique methodology that eliminates, and/or significantly reduces the many deficiencies associated with prior art. The present system may be installed on an imperfect surface while allowing for independent adjustment of the individual coffer modules and therefore providing the ability to achieve a perfectly level, straight and/or flat plane across the coffered ceiling system. The prefabrication and preassembly methods and processes of the present system allow it to be installed in 25% of the time of a conventional custom onsite installation. In renovation projects the shorter installation time equates to a reduction in disturbance to the homeowner and in commercial applications it equates to a reduction in down time and the resulting loss of business and/or functionality of the space.

Advantages of the above system may include one or more of the following. The unique custom coffered ceiling layout, fabrication, and installation methods and processes of the present system overcome the problems associated with prior art. By using the present system to pre-fabricate and pre-assemble individual coffer modules, with each module having its own integrated surface panel, it allows for consistently level, straight, and true installations regardless of the underlying substrate conditions. No matter how un-level, uneven, crooked or imperfect the substrate surface may be, the present system solves the problems associated with installing a coffered ceiling on such an imperfect surface. Furthermore, the present system significantly reduces the labor, time, materials, and equipment required to complete the installation process. It also substantially improves onsite safety conditions and cleanliness, all the while, significantly reducing the overall cost.

The level of quality that is able to be achieved by performing the prefabrication and preassembly processes under shop conditions is far superior than what can be achieved under the less than ideal conditions typically found onsite. As a result of the superior quality of the coffers the ted quality of the painting or staining can also be expected to yield superior results.

Since the components are being prefabricated offsite, onsite safety issues are significantly reduced. It does so by providing a proprietary measurement and layout system that ensures all components are produced accurately yielding precise coffer modules and an exact fit to a given ceiling or surface area.

The unique methods and processes for assembly of the present system are ideal for and befitting of an online business model as they allow for outsourcing of the manufacturing and/or installation methods and processes. Orders that are received by the authorized sales/marketing entity can be routed to a remote production facility for fabrication, assembly and shipment of the order to the customer. The installation of the finished product can then be scheduled with an authorized installer or completed by the customer themselves.

The information received in a purchase order, along with the site measurements, are first deciphered and confirmed with the customer prior to being converted into a production order. Once converted into a production order it is then routed to an authorized, outsourced manufacturing shop or facility with the required knowledge and equipment to fabricate, assemble and ship the finished product to the customer. The business model of outsourcing the manufacturing and production of the product relieves the authorized sales/marketing entity of the large initial setup costs associated with the establishment and ownership of a dedicated manufacturing facility as well as the expense and burden of the daily operation and the employees needed for such.

By outsourcing the manufacturing methods and processes the unique business model of the present system also serves to help pre-existing facilities, which are authorized to manufacture the present system, to increase their annual revenues with the additional sales from the production orders they receive. This forms a natural expansion for any shop or facility that has the proper knowledge and equipment to manufacture the present system as required. Likewise, the unique process for installation may also be outsourced to pre-authorized installers in various regions and/or territories or simply performed by the customer themself. This again relieves the expense and burden of employees and is befitting of an online business model.

Additional benefits to the present system include, but are not limited to, the ability to manufacture the coffer modules in a multitude of sizes, depths and shapes, for example, square, rectangular, triangular, octagonal, hexagonal, and even circular and various forms of oval and elliptical shapes. It provides the ability to utilize lower skilled and lower wage labor to install. It is fully customizable to fit virtually any ceiling/surface area perfectly and the short lead time to manufacture offers a tremendous benefit to customers under any circumstance. Since it may utilize commonly sized and readily available and/or stock woodworking materials, it is easier for an authorized manufacturing facility to control costs and to maintain short production lead times. The present system also has the ability to be prefinished in a wide variety of paint and/or stain finishes prior to shipment and/or installation reducing the time to finish it on-site after it has been installed. It also eliminates the need to fully finish the underlying substrate surface on which it will be installed thus saving the time, money and mess associated with such.

Some of the advantages of the present system include:

1) A substantial increase in overall quality and finish vs. conventional coffered ceiling installations.

2) A substantial decrease in the time required to complete the design, fabrication and installation.

3) A substantial decrease in the skill set and/or skill level required to complete the installation properly and with professional results.

4) A substantial increase in the safety of the installers and those working around them or on the same site.

5) A written installation process, with supporting photos and/or illustrations, that is consistent for all applications.

6) A substantial reduction in the amount of professional tools and equipment required to complete the installation.

7) Elimination of the need to measure, mark and layout the entire beam pattern on the substrate surface prior to starting the installation process.

8) The unique method requiring only two measurements in preparation for installation, which include a) the center of the length of the surface area, and; b) the center of the width of the surface area.

9) A substantial reduction in the amount of on-site fabrication and fastening required.

10) A substantial reduction in the mess and dust caused and/or created by the on-site fabrication (cutting and milling).

11) A substantial reduction in the disturbance caused to the customer in renovation and/or enhancement type projects.

12) An integrated ceiling panel that achieves complete coverage of the substrate surface hiding imperfections that may exist 13) Various design options for the integrated ceiling/surface panel including, but not limited to: a) plain smooth; b) applied molding; c) flat/recessed panel; d) raised panel, and; e) bead board panel.

14) A method of easy adjustment for a level and/or straight bottom surface by using shims, blocking or adjustable type mechanical fasteners.

15) The ability to be laid out and custom sized to fit virtually any surface area perfectly whether square, rectangular, hexagonal, octagonal or irregular in shape.

16) The ability to be manufactured in various common and/or exotic woodworking materials to suit the end user.

17) The ability to be prefinished in various paint or stain colors prior to being shipped and/or installed.

18) The ability to terminate the coffer modules and the ceiling system as a whole into the ceiling/surface substrate itself without the need for a perpendicular surface to create a termination or end point 19) The ability to fabricate the coffer modules with an arched ceiling/surface panel, arched beam wall boards and arched beam board moldings for installation on an arched ceiling/surface.

20) The ability to fabricate the coffer modules in geometric, circular and curved shapes or any combination of geometric, circular and curved shapes while allowing for a resulting pattern of beams that follows with the exact shapes of the modules.

21) The ability to install the beam board moldings in a floating manner where the top of the moldings do not need to touch or be secured to the ceiling panel and allowing for options such as backlighting to be used behind the beam moldings for an enhanced visual effect.

22) The ability to adjust the modules for level against an unleveled, crooked, wavy or otherwise imperfect ceiling/surface with the use of shims or mechanical fasteners.

23) The ability to set the coffer modules and the resulting ceiling system as a whole at an angle to the perimeter of the ceiling/surface without the need to remain parallel with or perpendicular to the ceiling/surface perimeter.

24) The ability to use or varying beam widths between the coffer modules within a complete coffered ceiling system.

25) The ability to add a secondary or false non-structural and non-integral ceiling panel within the perimeter of the beam wall boards and covering over the primary or essential ceiling panel of any coffer module to create varying degrees of visible depth between the bottom of the beam wall boards and the secondary ceiling panel and between the individual coffers within a complete coffered ceiling system.

26) The ability to install the coffer modules and the system as a whole on a vaulted, slanted or sloped ceiling ceiling/surface area.

27) The ability to install the coffer modules with flat ceiling/surface panels and the system as a whole on an arched ceiling/surface without having to construct the coffer modules or the system as a whole with arched components.

Furthermore, it is an object of this application to illustrate the preferred embodiments and broadly state the methodologies that may be used in order to manufacture and install a permanently affixed, fully customizable coffered ceiling system of superior quality in a fraction of the time vs. conventional custom onsite methods.

DETAILED DESCRIPTION OF THE INVENTION

In the following, the description, as well as parts thereof, will be described, and by way of example, the same or similar elements will have the same or similar reference signs. For these embodiments, arches, curves, angles are described. An arch has to be understood as also meaning at least, but not limited to, components which have a radius that is perpendicular to the ceiling/surface panel, while a curve has to be understood as also meaning at least, but not limited to, components which have a radius that is parallel to the ceiling/surface panel and angle has to be understood as also meaning at least, but not limited to, components which are positioned in a manner other than parallel or perpendicular in relation to one another.

A. DESCRIPTION OF THE PRESENT SYSTEM

Figure 1:
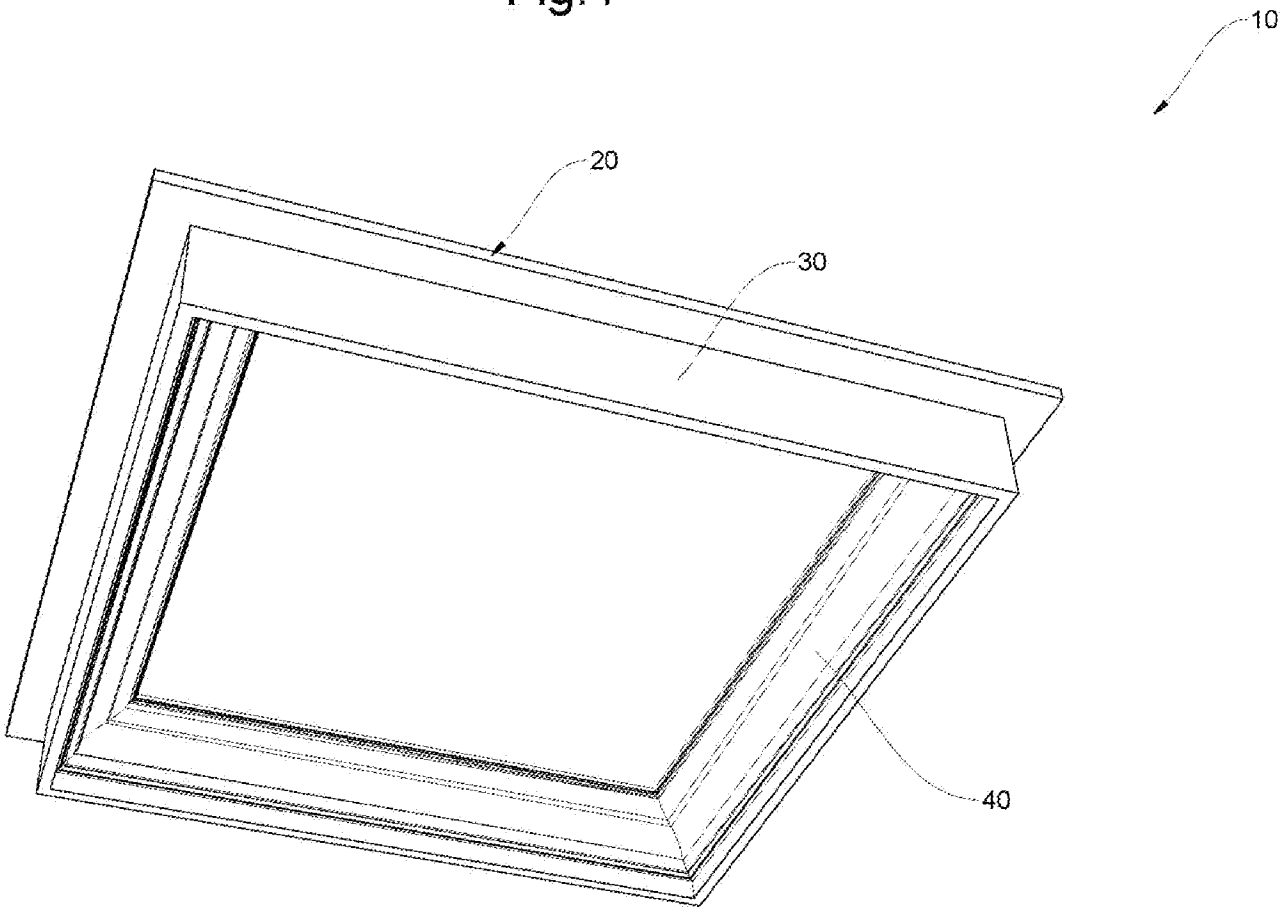
FIG. 1 is a perspective view of the present system illustrating a single coffer module with a flat ceiling/surface panel with all square corners and all straight beam wall boards and beam board moldings.
Figure 2:
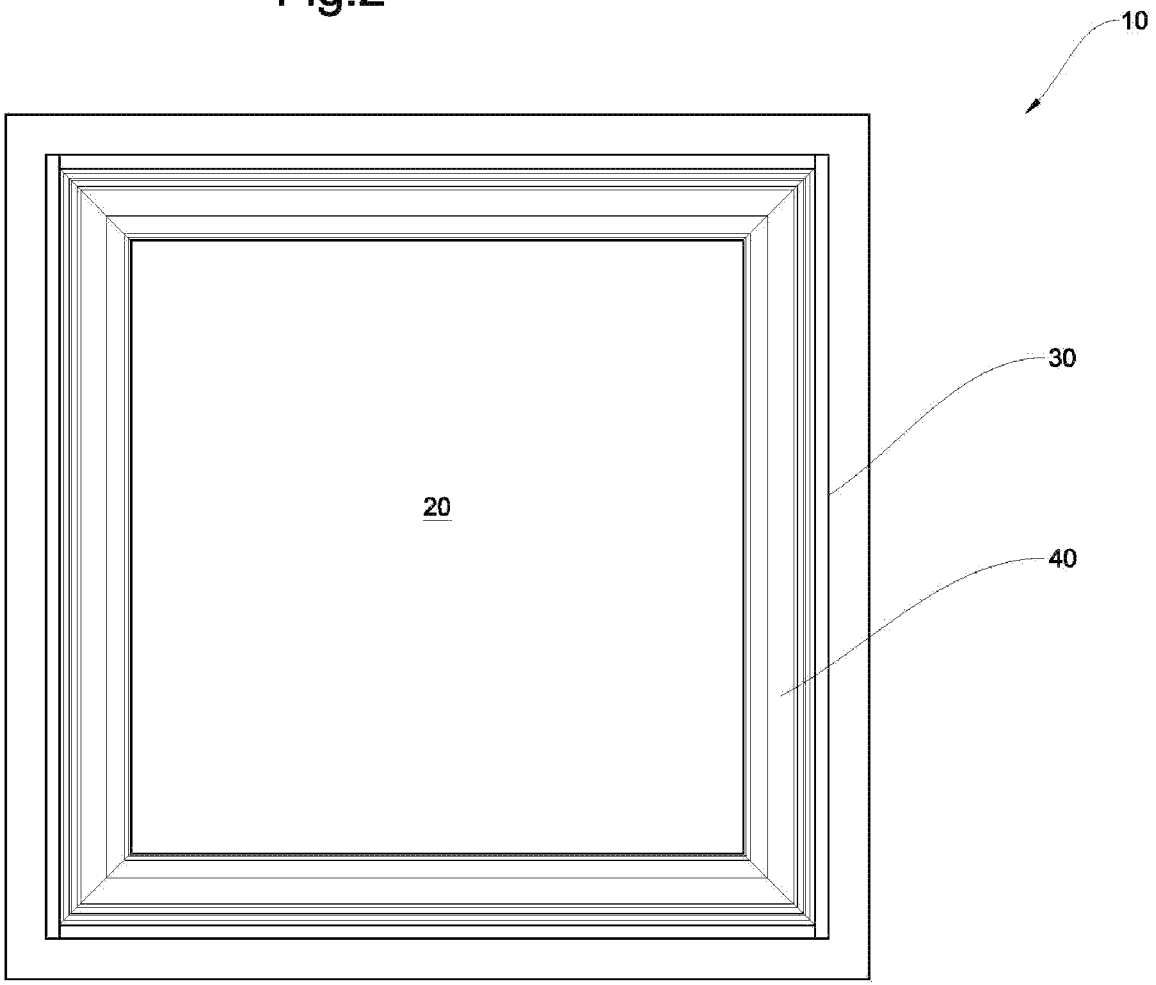
FIG. 2 is a plan view of the present system illustrating a single coffer module with a flat ceiling/surface panel with all square corners and all straight beam wall boards and beam board moldings.
Figure 3:
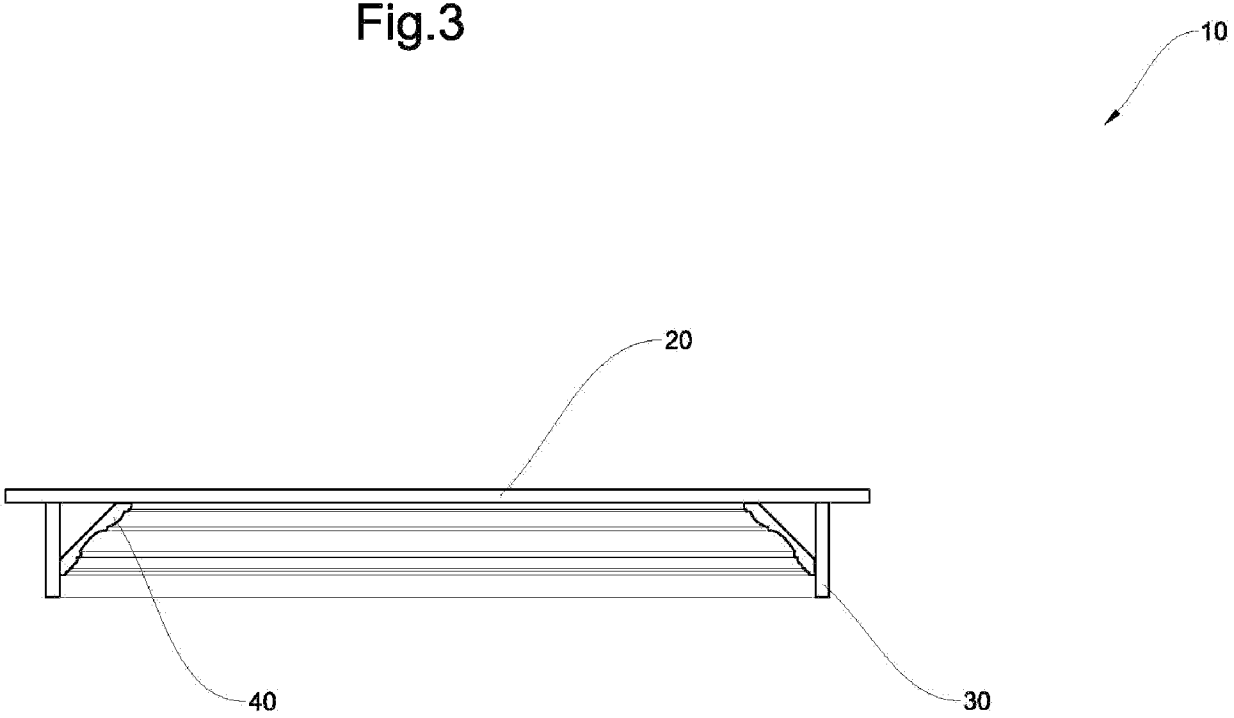
FIG. 3 is a cross-sectional view of the present system illustrating a single coffer module with a flat ceiling/surface panel and straight beam wall boards and beam board moldings.

In FIGS. 1, 2 and 3, the single coffer module of the present system 10 consists of a ceiling/surface panel 20, a beam wall board 30 and a beam molding 40.

Figure 4:
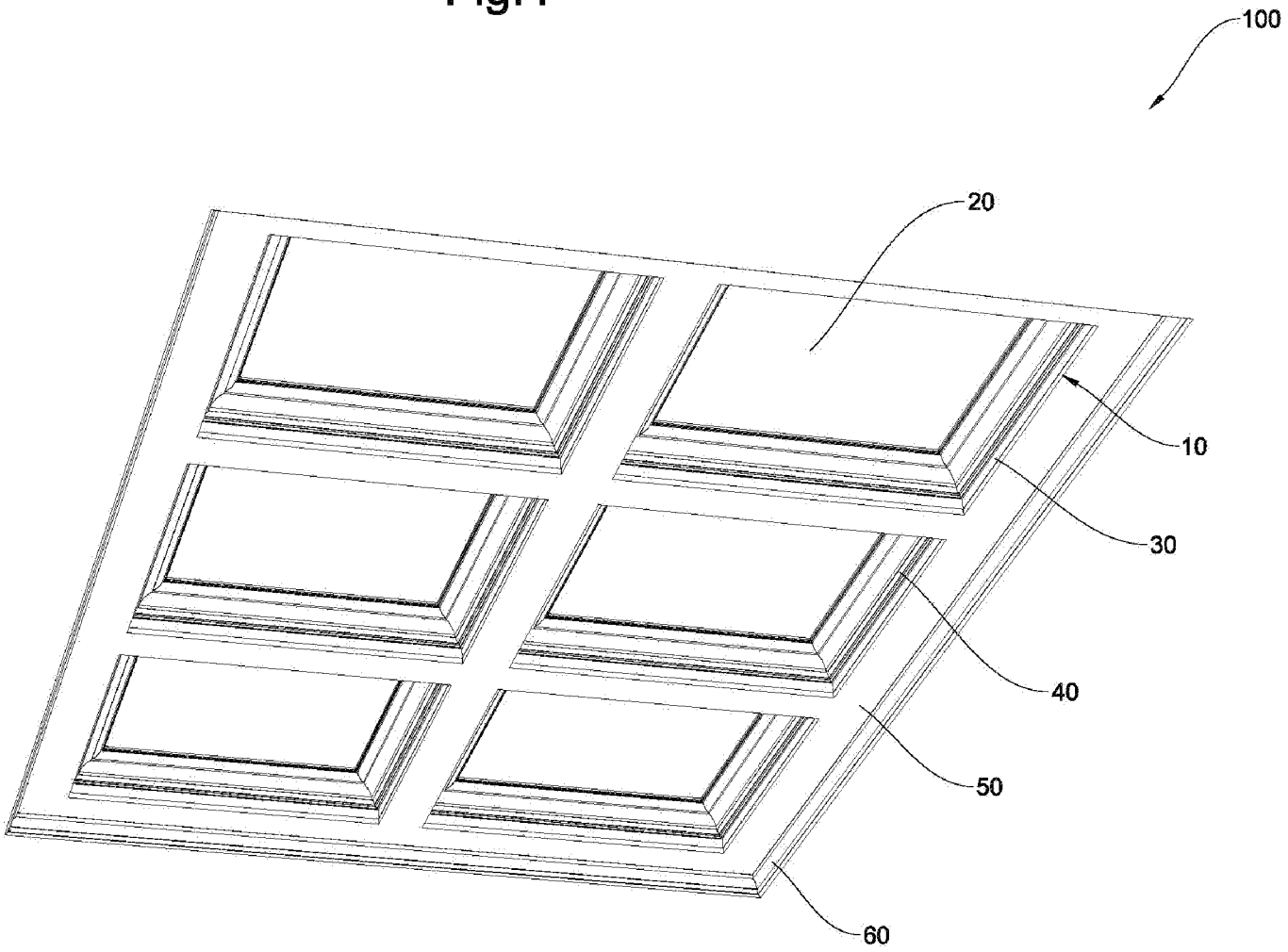
FIG. 4 is a perspective view of the present system illustrating a complete coffered ceiling system utilizing coffer modules with flat ceiling/surface panels with all square corners and all straight beam wall boards and beam board moldings on a flat surface as it terminates into surrounding perpendicular walls/surfaces.
Figure 5:
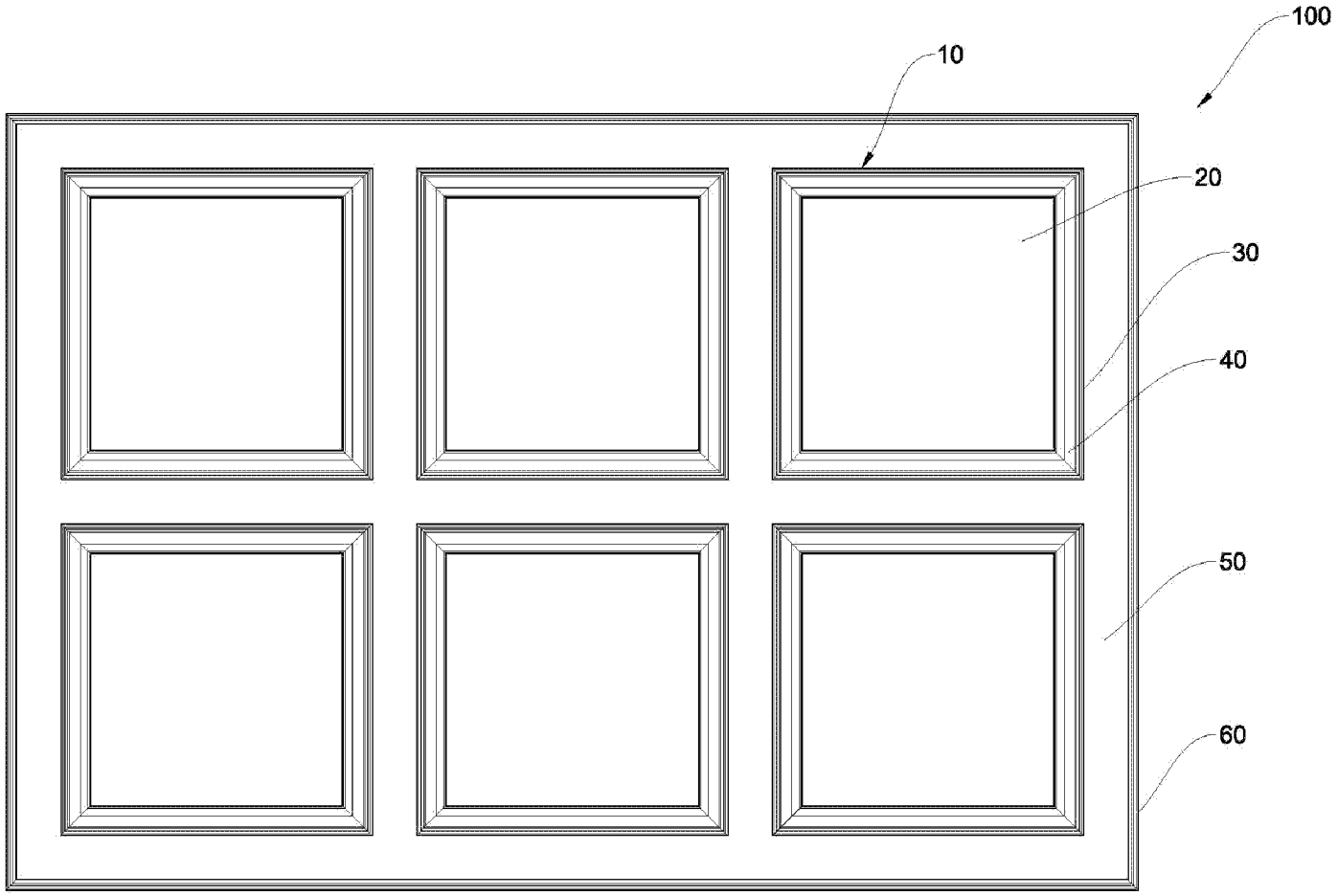
FIG. 5 is a plan view of the present system illustrating a complete coffered ceiling system utilizing coffer modules with flat ceiling/surface panels with all square corners and all straight beam wall boards and beam board moldings on a flat surface as it terminates into perpendicular walls/substrate surfaces.

As illustrated in FIGS. 4 and 5, an entire coffered system of the present system 100 consists of six modules, in which is like that of the system 10 in FIGS. 1, 2, and 3, and is comprised of ceiling/surface panel 20, a beam wall board 30, a beam molding 40. The other five are essentially identical (not numbered). The six modules have been installed with beam bottom board 50, and perimeter molding 60 in place. While the appearance of FIGS. 4 and 5 may resemble prior art, this completed system of the present system as will be further described in the following Figures will show the unique, yet significant differences that overcome the substantial deficiencies of prior art. It is obvious to anyone who makes coffered ceilings that there may be any number of actual coffered components, for example, four, eight, seventy and so on.

Figure 6:
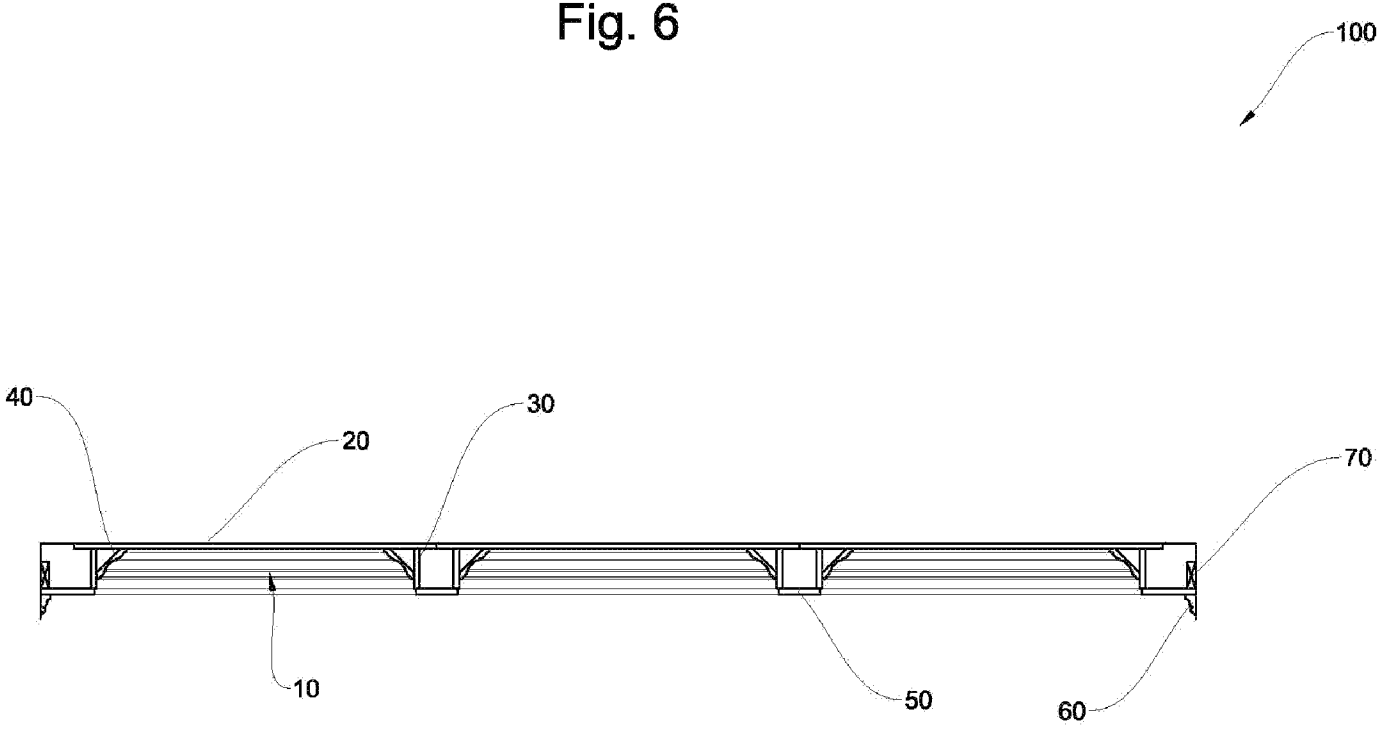
FIG. 6 is a cross-sectional view of the present system illustrating a complete coffered ceiling system on a flat surface as it terminates into perpendicular walls/substrate surfaces.

In FIG. 6, the entire coffered system of the present system 100 and its components consisting of modules such as the present system 10, a ceiling/surface panel 20, a beam wall board 30, a beam molding 40, and the addition of beam bottom board 50, and a perimeter molding 60, and a nailer board/block 70. Likewise, while the appearance of FIG. 6 may resemble prior art, this completed system of the present system will be further described in the following Figures and will show its unique, yet significant differences that overcome the deficiencies of prior art.

Figure 7:
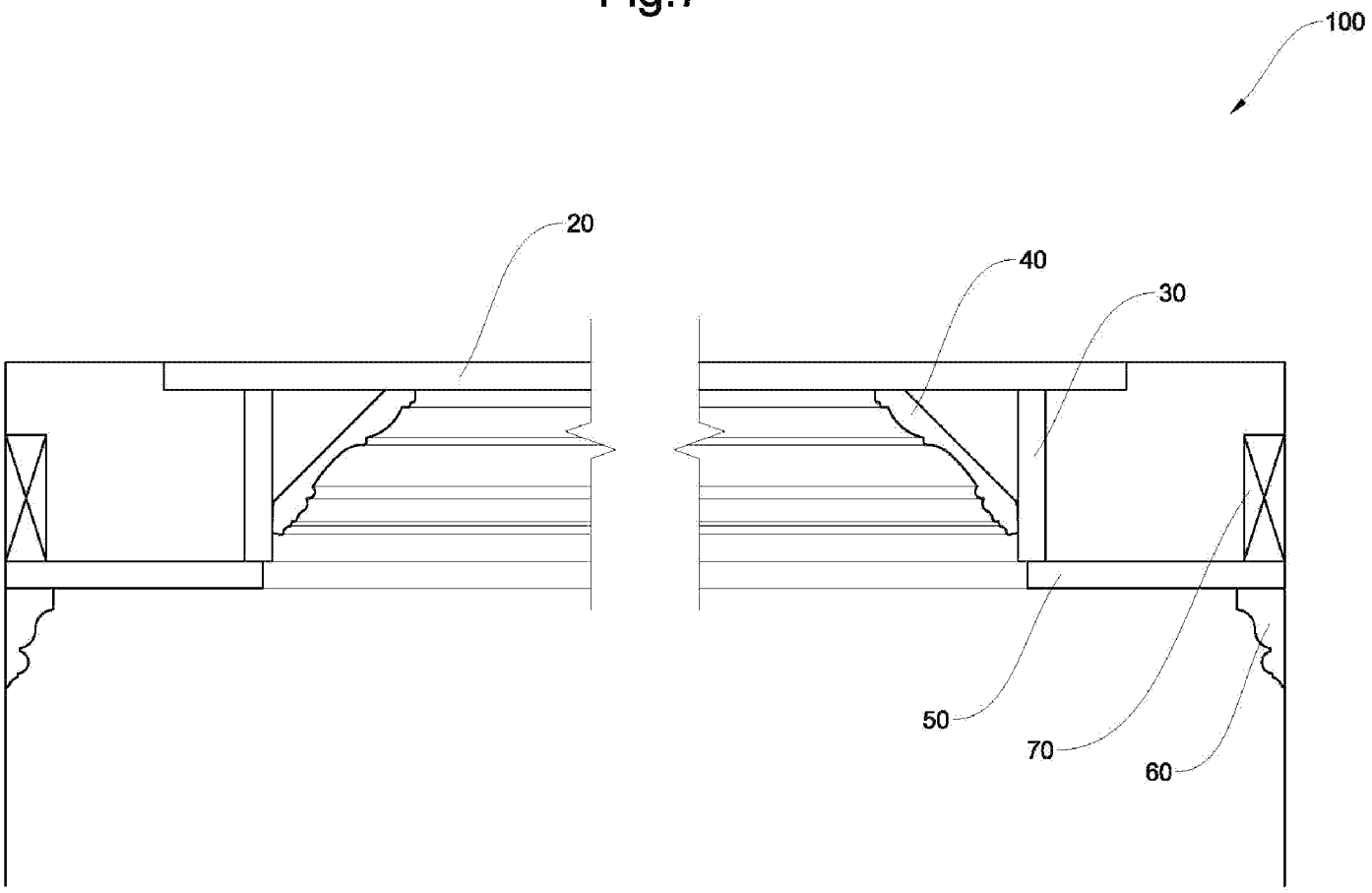
FIG. 7 is a blown-up cross-sectional view of the present system illustrating the perimeter beam assembly portions of a coffered ceiling system as they terminate into perpendicular walls/surfaces.

In FIG. 7 the perimeter beam detail of the coffered system of the present system 10 consists of a ceiling/surface panel 20, a beam wall board 30, a beam molding 40, a beam bottom board 50, and a perimeter molding 60, and a nailer board/block 70. This is typically how it terminates to a perpendicular wall or surface. In certain cases, one or more of the perimeter beams of the present system may not terminate at a wall. For example, it may terminate into the substrate itself instead of a surrounding wall. For example, the coffered ceiling may appear to only cover a centralize portion of the ceiling, or some other partial sector.

B. METHOD OF MANUFACTURE AND INSTALLATION

Figure 8:
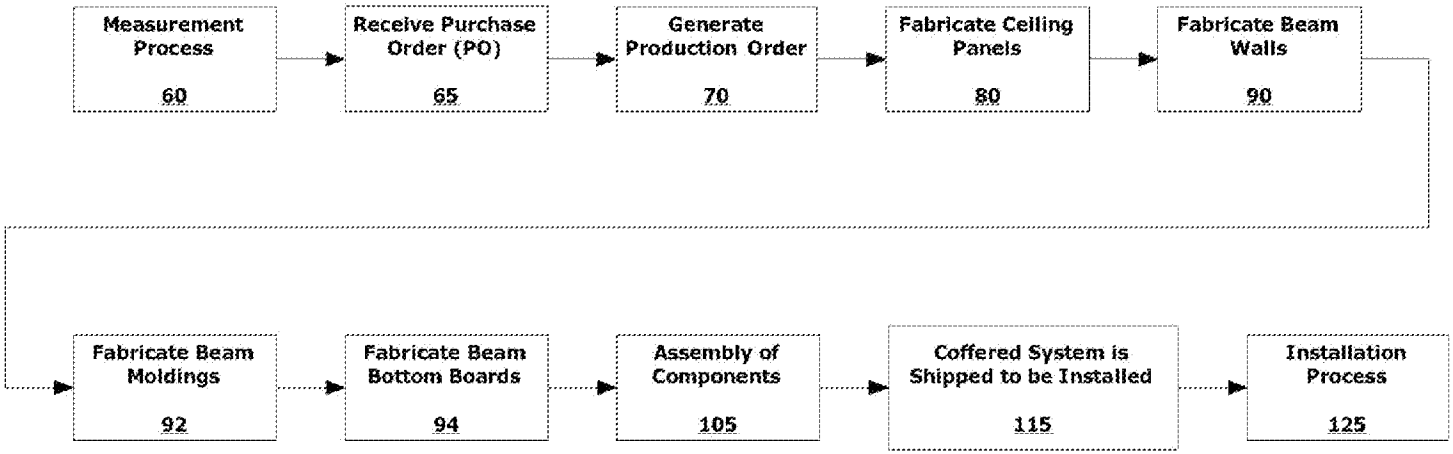
FIG. 8 is a block diagram of the manufacturing and installation processes of the present system.

In FIG. 8 the preferred method of manufacture 50 begins with a typical user (may be a customer, installer or otherwise) initiating the measurement process 60 by using an appropriate measuring device to determine the smallest or shortest dimension for both the length and width of the intended substrate. The measurement process helps to determine if the walls are or aren't straight, parallel and/or square. If measuring from a median or larger or the largest measurements would require trimming down and tapering the perimeter beam board. This is time consuming, difficult and aesthetically inferior.

The present system overcomes the issues and problems associated with an "out of square" substrate by allowing for the outermost edge of the outer perimeter beam boards to be scribed or tapered as needed to fit within the surrounding walls while the coffer modules and other coffered system components are able to remain perfectly square. The outermost perimeter molding aids in this process by relieving the installer of having to make perfect scribes or tapers on the outer beam boards as the molding covers the varying degrees in the space between the outer edge of the outer beam boards and the surrounding walls.

With receipt of the dimensions from the user from the measurement process 60 a purchase order 65 is generated. Upon customer approval of the purchase order a production order 70 is generated and sent to an authorized manufacturing facility (AMF) for fabrication and assembly of the coffered ceiling system components. Next the AMF uses production order 70 to fabricate the ceiling/surface panels 80 which are completed accordingly. The ceiling/surface panels may include one or more processes for fabrication which may include preassembly. For example, with virtually endless design possibilities, various equipment, joinery, fasteners and so on may be used for the fabrication of the panels. In one embodiment, once fabrication 80 is complete the panels are then prepped with a dado groove that receives and aligns the beam wall boards during the assembly process. The beam wall fabrication process 90 cuts each board to the specified length and width. The beam wall boards are preferably then prepped on each of the short ends for one of several types of joinery methods including, but not limited to a dado, a miter, a lock miter, dowels, screws, pocket screws and so on. The joinery types aid in aligning the beam boards perpendicular to one another during the assembly process as well as proving a strong bond between the beam boards. Next, the beam molding fabrication process 92 cuts the beam moldings to the specified lengths with a preferably a miter or cope on each end. Typically, the order calls for an additional stage of fabrication wherein the beam bottom board process 94 cuts the beam bottom boards to the specified lengths and widths. Upon completion of steps 70 through 94, the components are ready for assembly.

The fabrication of the beam boards may also be done on site by purchasing material from a local supplier and fabricating them on site. Likewise the construction of the beam boards as previously described may be accomplished by a myriad of tools, saws and so on and is not to be considered limited to those cited. While the material is typically some form of wood, it is conceivable it may include plastic or perhaps in some applications, a form or metal such as copper.

With the components fabricated, assembly 105 begins by applying glue or adhesive to the edge of the beam wall boards and setting them perpendicular to the ceiling/surface panels using the dado groove in the face of the panels as a guide for placement in one embodiment. The beam wall boards are then fastened to the panels using one or a combination of several types of fasteners including, but not limited to nails, screws, biscuits, dowels and so on. Assembly is completed by installing the beam board moldings one at a time in either clockwise or counter clockwise sequence inside of the completed panel and beam wall board assembly. Each piece is fastened in place using glue or adhesive and nails, or any other form of fastener.

The advantages of the present system as described in FIG. 8 are substantial. For example, it may be pre-assembled, which requires no onsite assembly. In this manner, the modules are shipped in a crate, box or otherwise and may be immediately fastened to the substrate when received. Or, they may be offered in a knocked down or unassembled disposition to reduce the overall size and packaging thus reducing shipping costs. In this instance, on-site assembly of the coffered modules is required prior to fastening the modules to the substrate. This unique process 50 also provides innumerable design and material potentials, for example various woods, plastics, gold inlaid materials, metals and so on.

Upon completion of the fabrication process the pre-assembled present system is shipped to be installed 115 and then is installed 125 by a) locating and marking of center of both the length and width of the ceiling or surface area; b) locating and marking of the underlying framing joists or studs of the ceiling or surface area for secure fastening of the coffer modules; c) installing the coffer modules using the specially designed shim screws; d) trimming the length of and installing the intersecting beam bottom boards; e) trimming the length of and tapering or scribing the width of the outer perimeter beam bottom boards as or if needed and; e) trimming the length of and installing the outermost perimeter moldings.

When the present system is not pre-assembled, additional installation steps are required between 125 *b*) and 125 *c*) in the preceding paragraph. These may include: b1) Applying adhesive to the edge of the beam wall boards and setting them perpendicular to the ceiling/surface panels, using the dado groove in the panels as a guide for placement, and; b2) the beam wall boards are then permanently fastened to the panels using either one or a combination of several types of fasteners including, but not limited to nails, screws, biscuits, dowels and so on and; b3) the beam board moldings may then be installed one at a time in either a clockwise or counter clockwise sequence inside of the completed panel and beam wall board assemblies. Each piece may then be fastened in place using glue or adhesive and nails or other fastener type.

The manufacturing process as described does not necessarily need to include the installation process 125. Manufacturing the present system primarily includes the processes 70 through 115. The installation process 125 is included herein to solely clarify the how the present system may be installed, thus taking advantage of its unique qualities.

C. OPERATIONS SUPPORTING CUSTOM COFFERED CEILING SYSTEM

Figure 9:
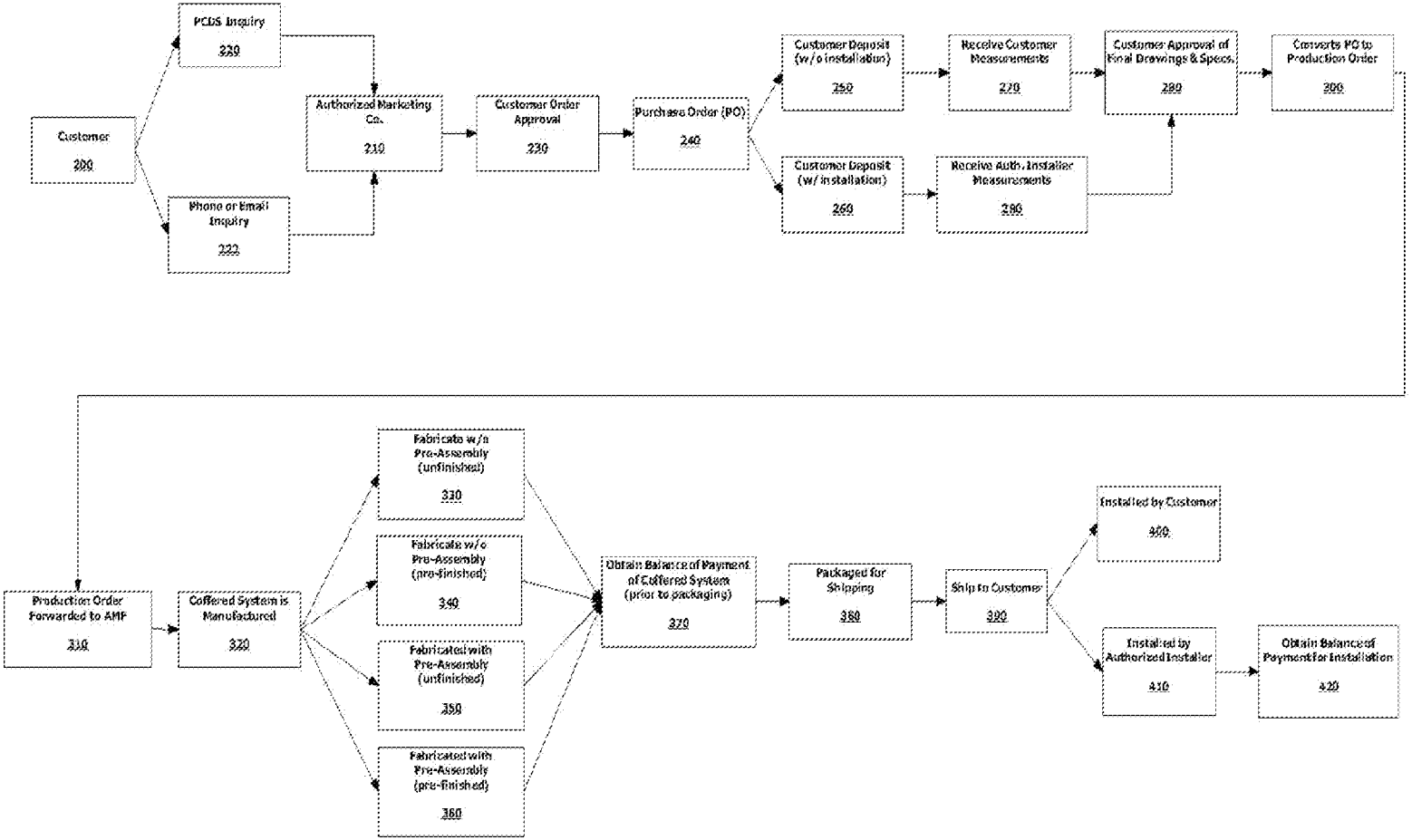
FIG. 9 is a flow chart showing the complete online business model/process of the present system.

In FIG. 9 customer 200 provides ceiling or surface area dimensions, as well as desired layout and design specifications to an authorized sales/marketing (ASM) entity 210 via the unique parametric coffer design software (PCDS) 220 or by direct email, phone or fax for quotation purposes. A design drawing is either generated by the PCDS 220 or may be created by the ASM 210 using conventional methods. The PCDS enables customer 200, the ASM 210, or any other user, to determine a layout, view the design, and calculate an estimated cost based on the selected parameters and input. As the inputs to the PCDS are adjusted or changed by the user the cost estimate also changes accordingly. For the ASM, the PCDS provides a complete list of the quantity of materials needed to fabricate the specific coffered ceiling system and for the AMF it calculates a material cut list for all of the manufacturing processes as described in FIG. 9.

Upon confirmation of the overall design, specifications and cost 230 and acceptance by customer 200 a purchase order 240 is generated and sent to customer 200 for its final review and signature of approval. Customer 200 signs purchase order 240, returns it to the ASM, which may include a deposit for the system without installation service 250, or with installation service 260.

Upon receipt of the signed purchase order 240 and the order deposit 250 or 260, precise site measurements may be obtained by way of customer submittal 270 or authorized installer submittal 280. Once received the precise site measurements are used to produce final design drawing(s) 290. Final design drawing(s) 290 are then submitted to the customer 200 for signature of approval and returned to the ASM.

With the signed final design drawings received a production order 300 is generated and sent to an AMF 310. At the AMF 310 the coffered module components are manufactured 320 as required. The production order 300 may be either fabricated without preassembly and unfinished 330, without preassembly and prefinished 340, pre-assembled and unfinished 350, or pre-assembled and prefinished 360.

Upon completion of the fabrication process the balance of payment for the order 370 is obtained from the customer. Once the balance has been received the completed coffer system components and/or modules are packaged for shipment 380 to customer 200 and may be shipped by any conventional means 390. Upon receipt of the coffer system it may be completed by way of customer installation 400, or by authorized installer 410. The installation 400 or 410 typically includes fastening of the coffer modules to the substrate and then finishing them with the installation of the beam bottom boards and the perimeter molding. If the installation is performed by an authorized installer 410 then the balance of payment for the installation 420 is collected on completion.

The business model and methodology described may also include other variables such as the elimination of a deposit, whereas payments are made after installation has been completed. It may also include a model where payment is made in whole upon, or perhaps even after the actual installation. The intention of this business model is not to provide a business model, which is typical in this day and with current contracting methodologies. However, it is also the intention to provide a broader model that may be adaptable to other forms of billing methods that may evolve in the future.

The business model of the present system may also include a method whereas the ASM, the PCDS, and the AMF, are one and the same entity. While it may be interpreted as a single entity, it nevertheless functions in concert with the present system herein as each on of the components, the ASM, PCDS, and the AMF, function as an independent department within the entity.

Figure 10:
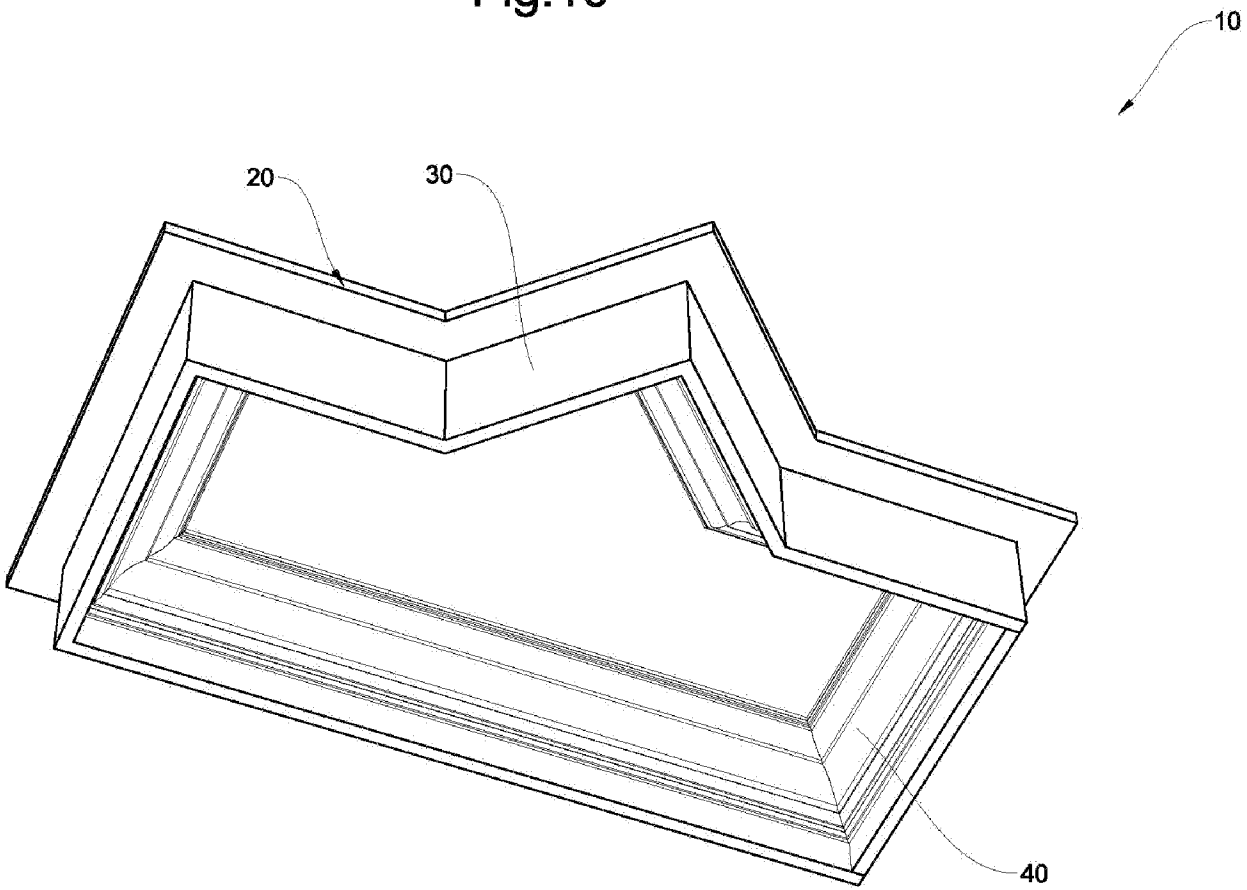
FIGS. 10-40 show exemplary embodiments of the coffer module.

FIG. 10 is a perspective view of the present system illustrating a single coffer module with a flat ceiling/surface panel with square and angled corners, and both straight and angled beam wall boards and beam board moldings. The result is a coffer shape that provides a 3D relief shape which has a substantially rectangular outline with a V shaped wedge extending from one side of the rectangular outline.

Figure 11:
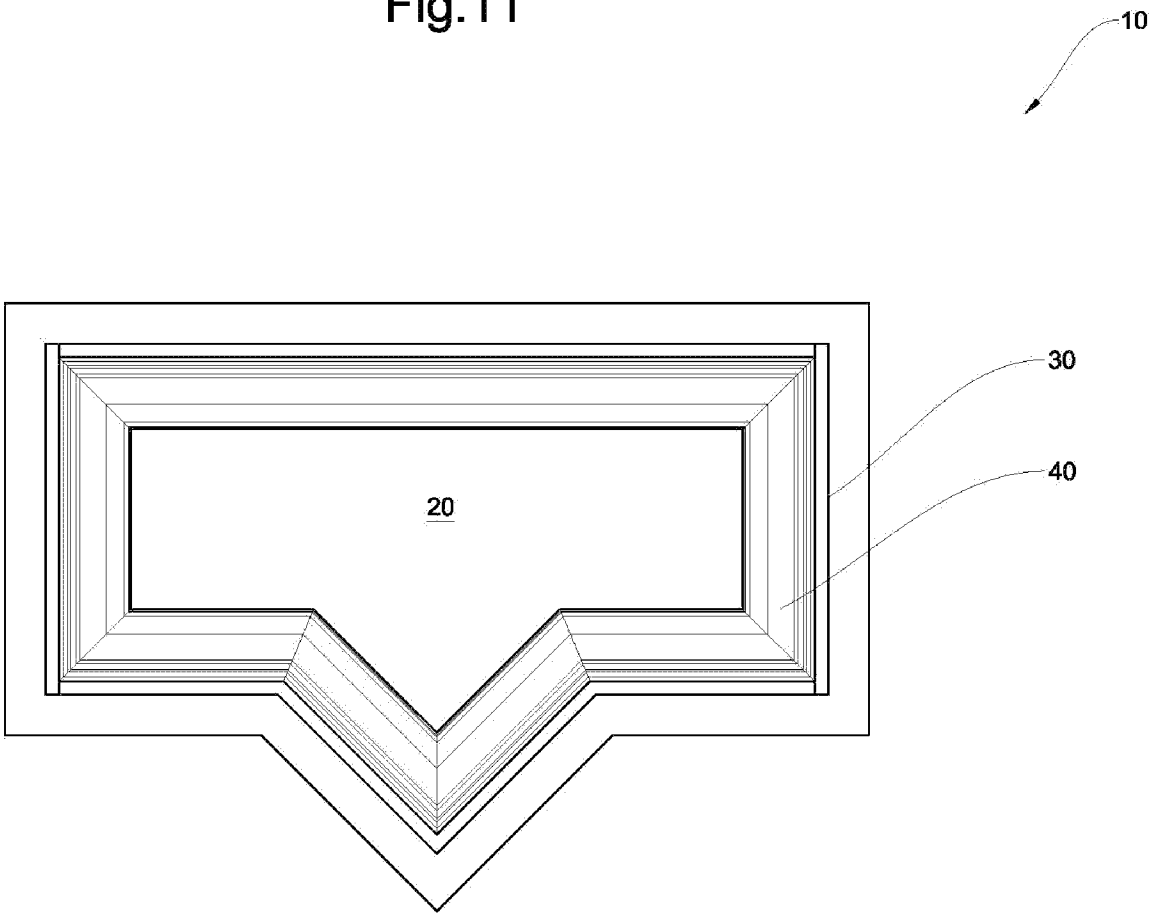

FIG. 11 is a plan view of the present system illustrating a single coffer module with a flat ceiling/surface panel with square and angled corners and both straight and angled beam wall boards and beam board moldings.

Figure 12:
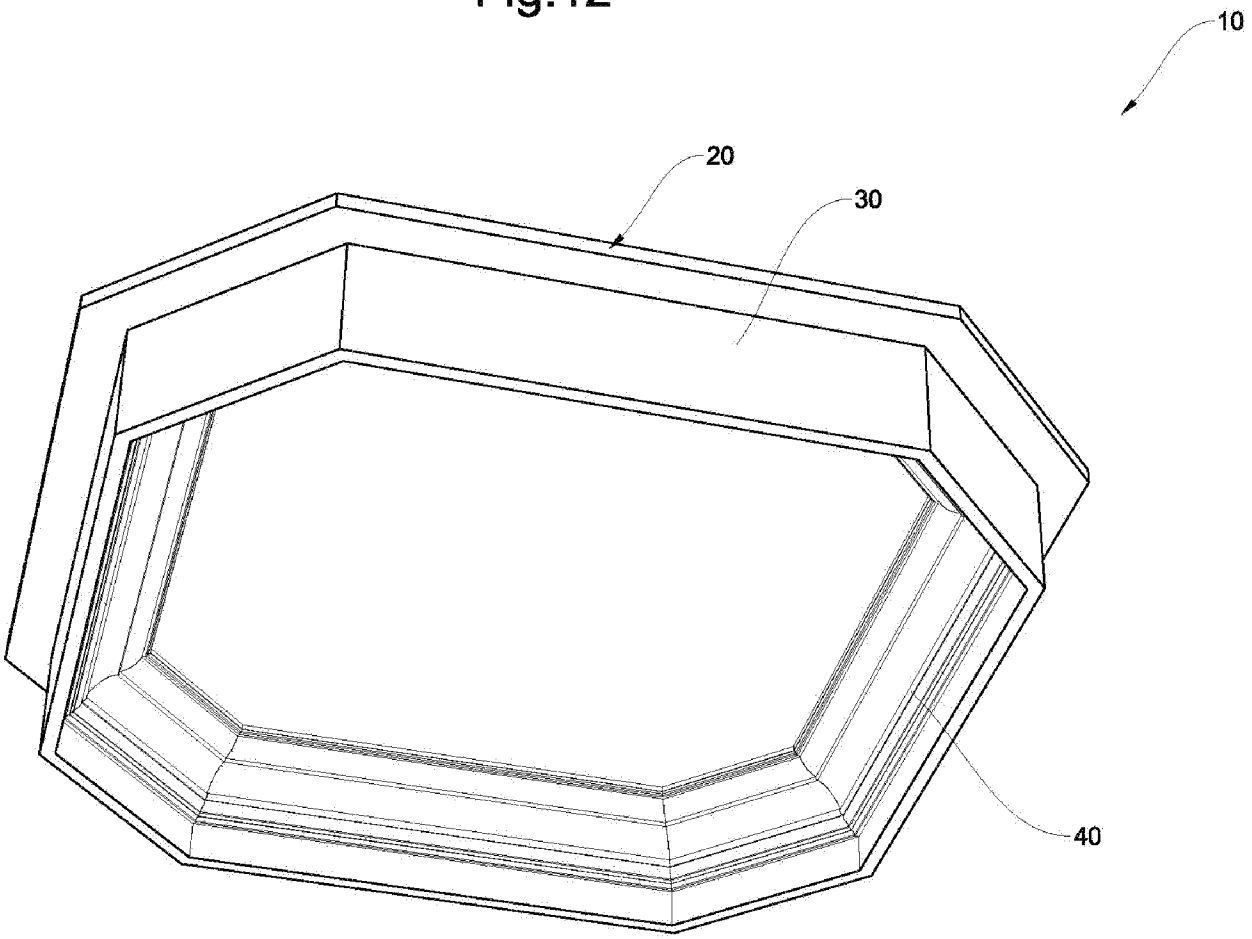

FIG. 12 is a perspective view of the present system illustrating a single coffer module with a flat ceiling/surface panel with all angled corners and both straight and angled beam wall boards and beam board moldings as they relate to one another.

Figure 13:
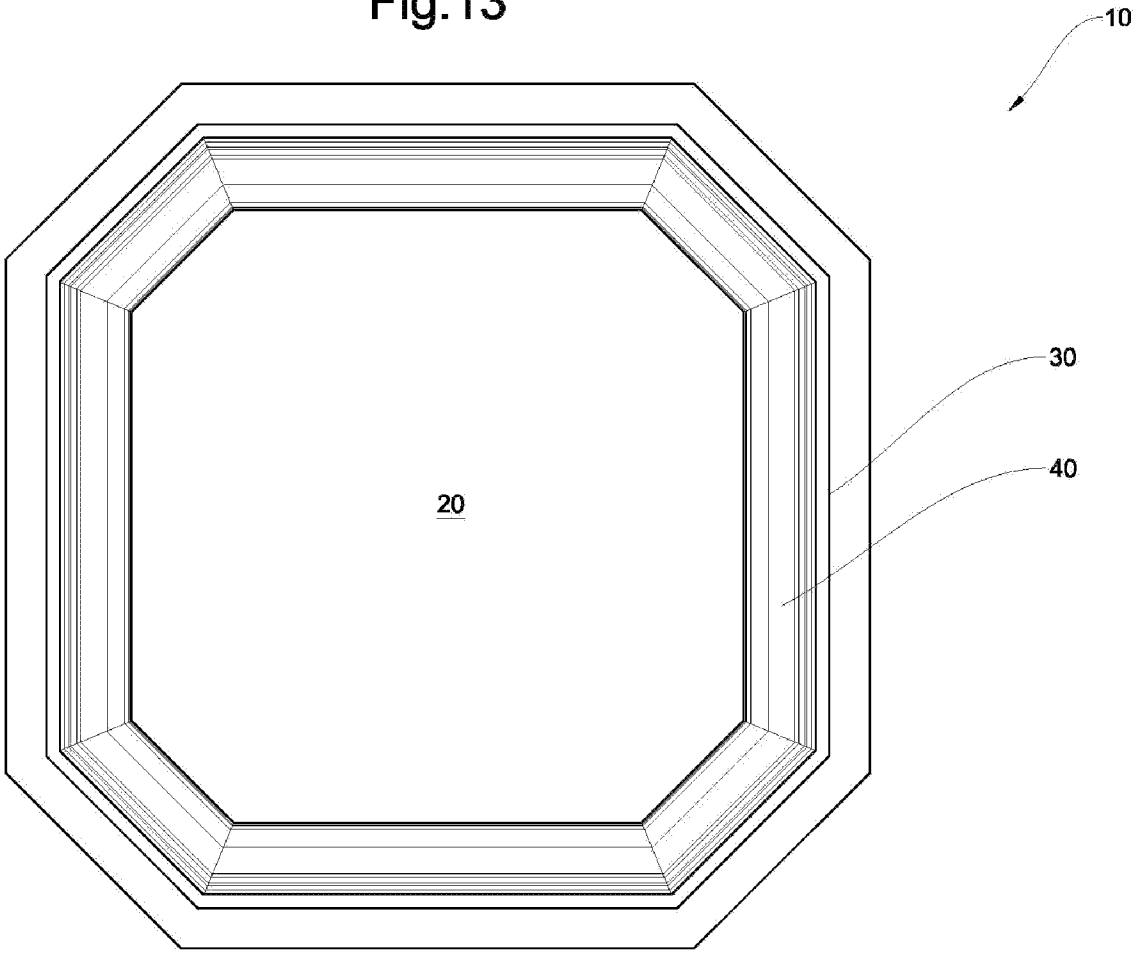

FIG. 13 is a plan view of the present system illustrating a single coffer module with a flat ceiling/surface panel with all angled corners and both straight and angled beam wall boards and beam board moldings.

Figure 14:
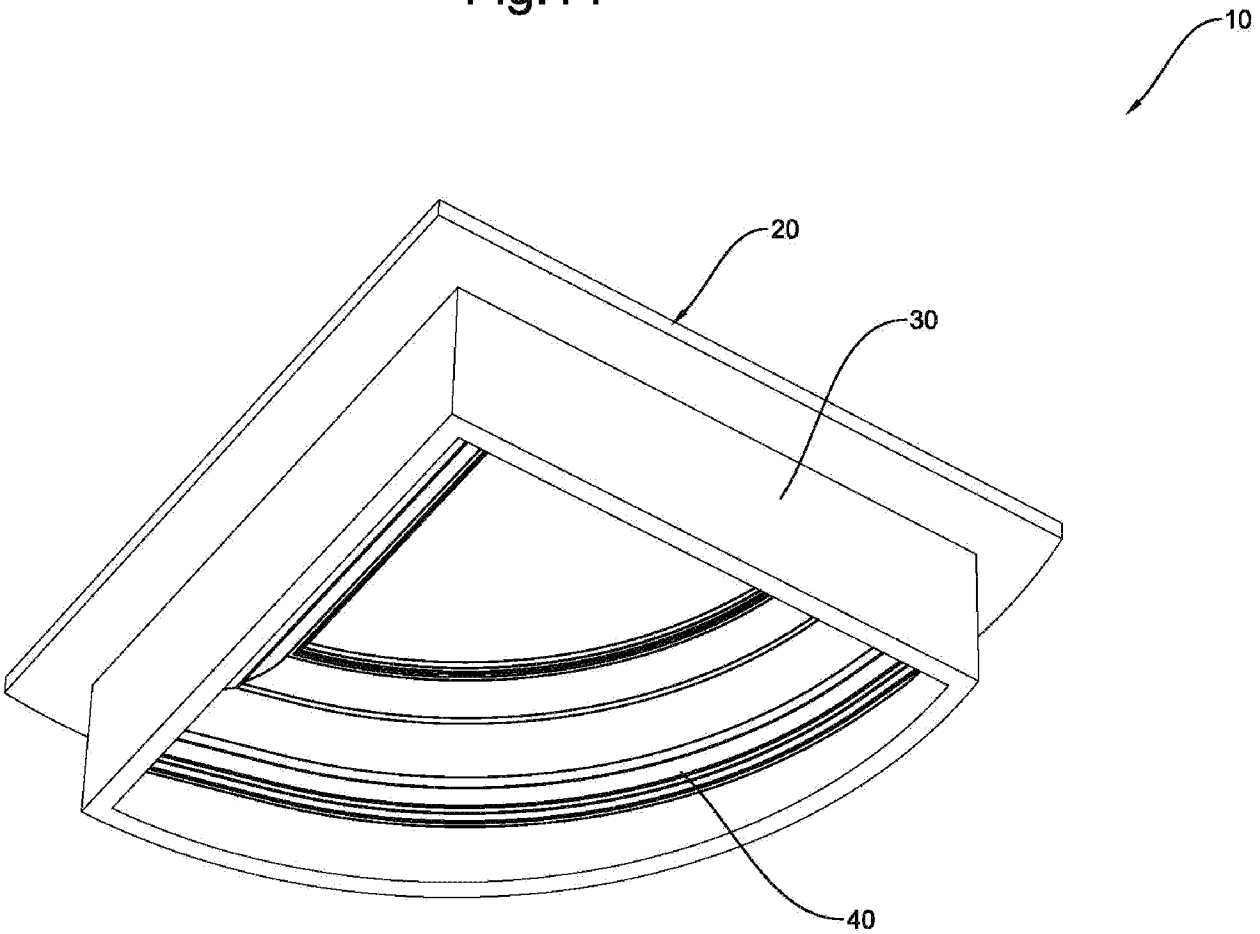

FIG. 14 is a perspective view of the present system illustrating a single coffer module with a flat ceiling/surface panel with both square and radius corners and straight and curved beam wall boards and beam board moldings.

Figure 15:
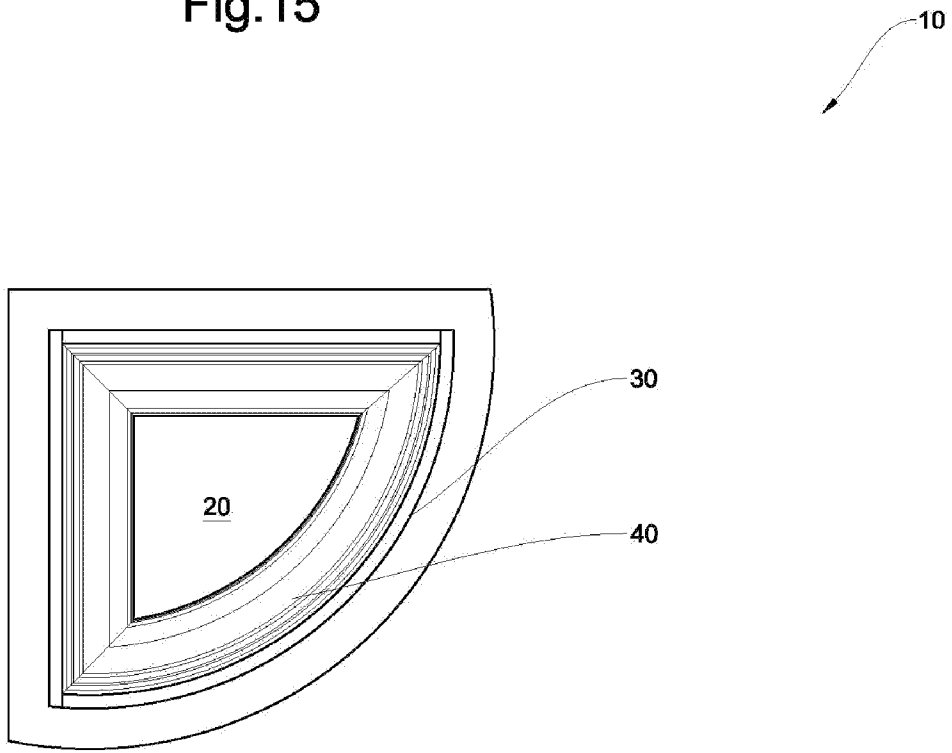

FIG. 15 is a plan view of the present system illustrating a single coffer module with a flat ceiling/surface panel with both square and radius corners and straight and curved beam wall boards and beam board moldings.

Figure 16:
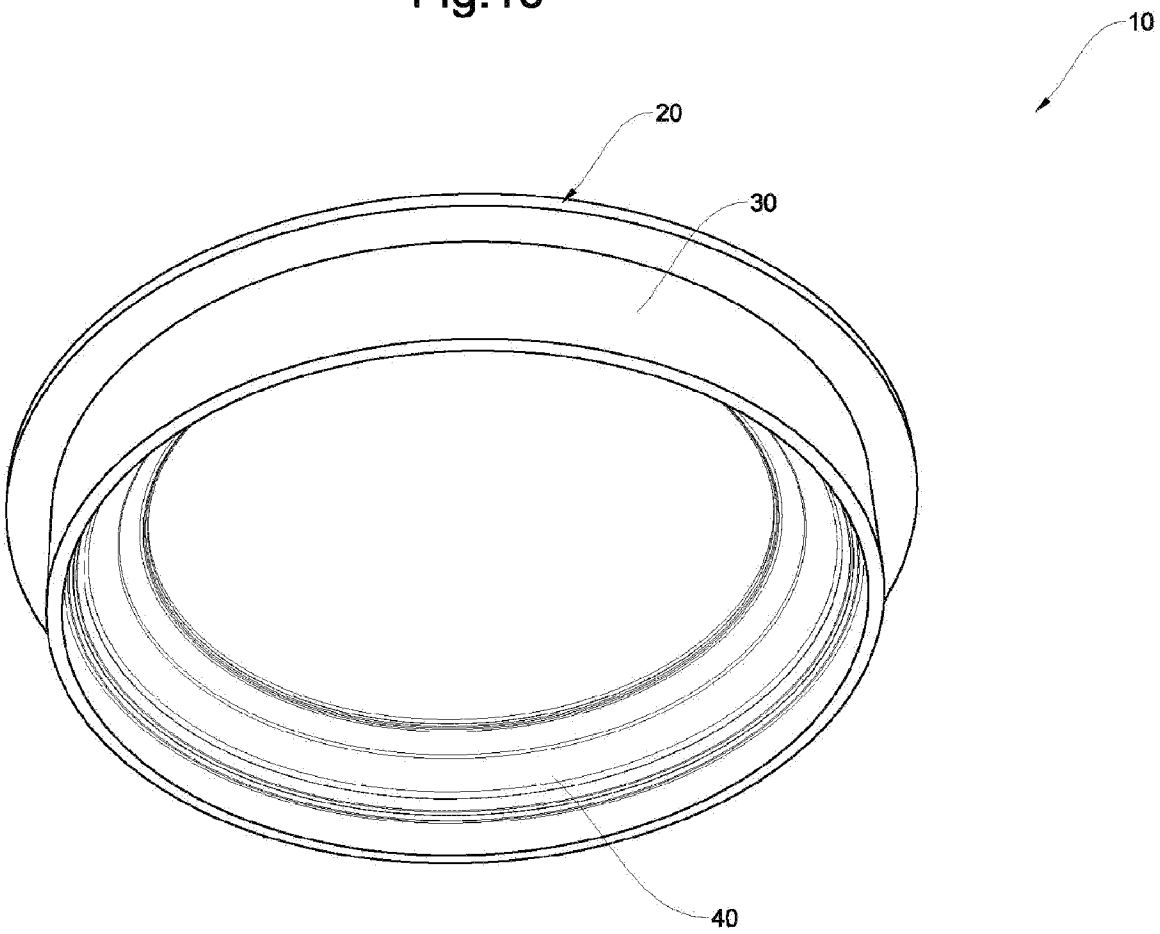

FIG. 16 is a perspective view of the present system illustrating a single coffer module with a flat ceiling/surface panel with all radius corners and all curved beam wall boards and beam board moldings.

Figure 17:
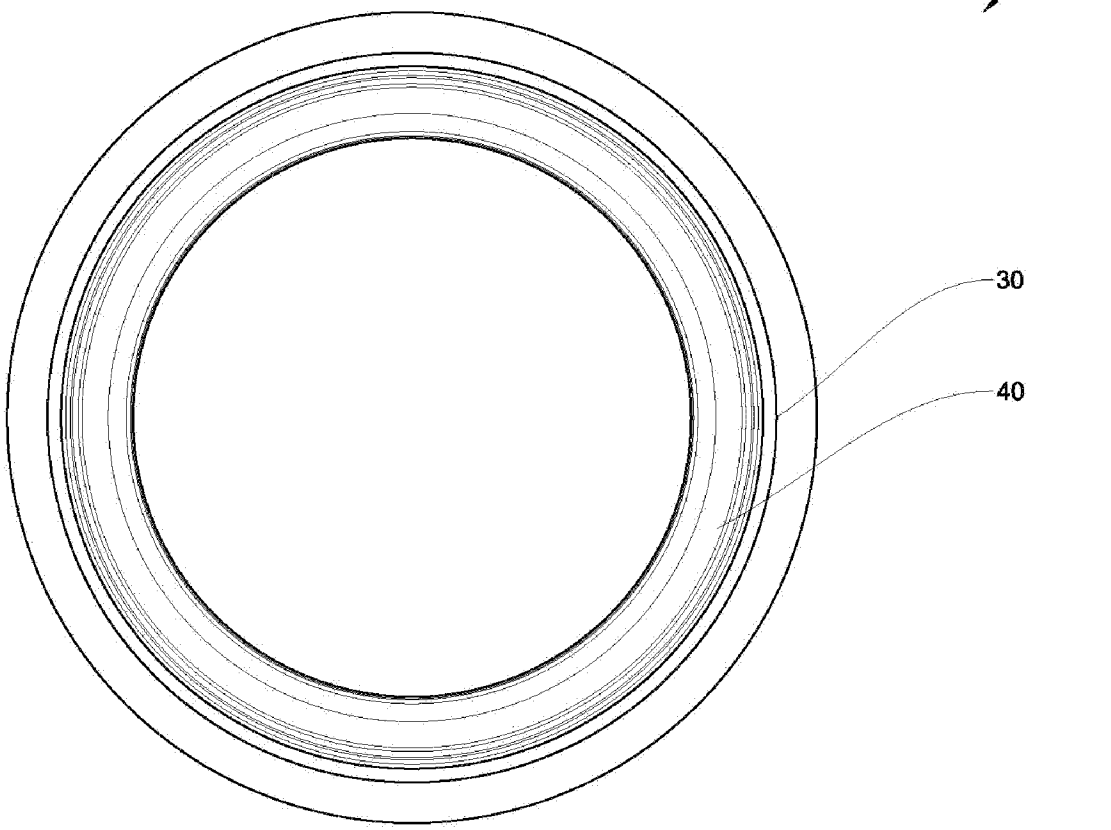

FIG. 17 is a plan view of the present system illustrating a single coffer module with a flat ceiling/surface panel with all radius corners and all curved beam wall boards and beam board moldings.

Figure 18:
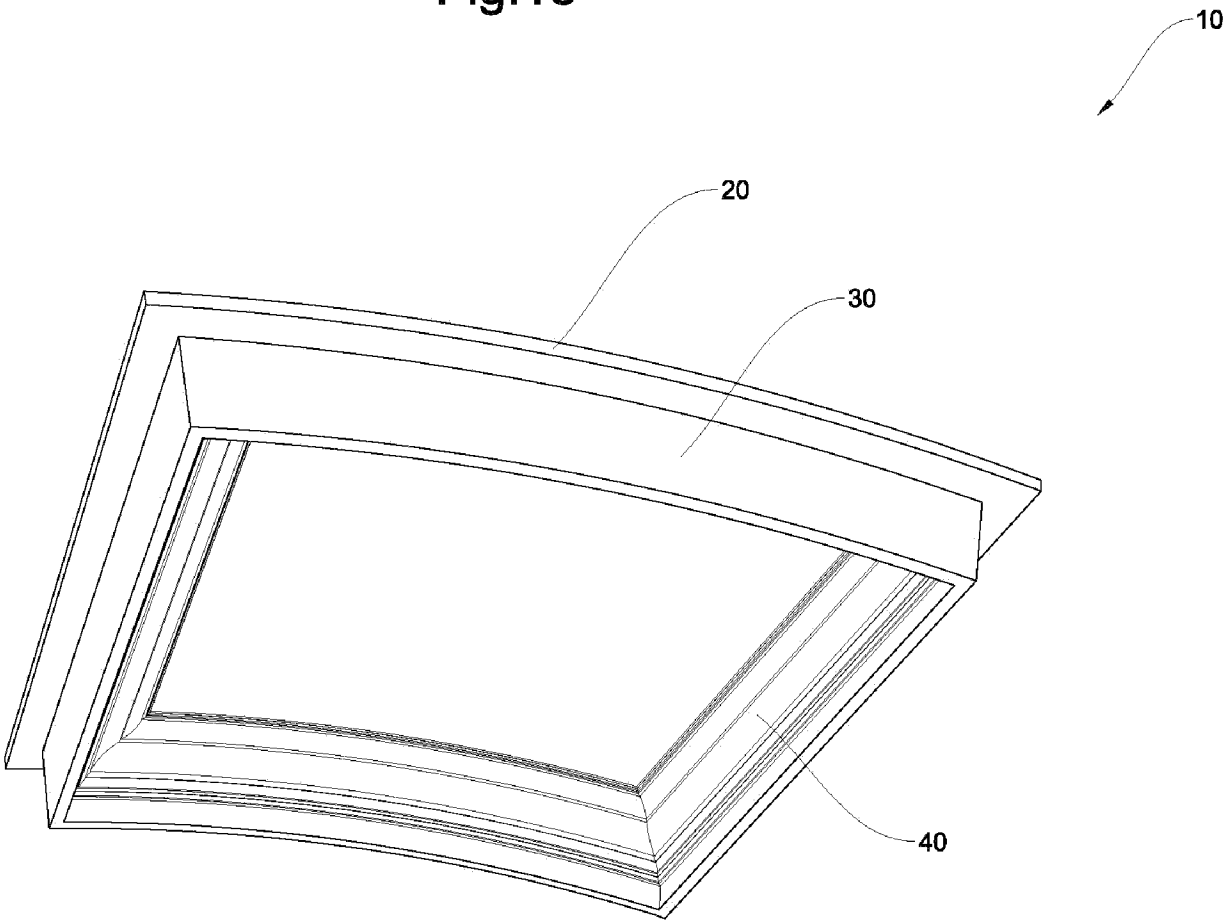

FIG. 18 is a perspective view of the present system illustrating a single coffer module with an arched ceiling/surface panel with all square corners, all straight sides, and both arched and straight beam wall boards and beam board moldings.

Figure 19:
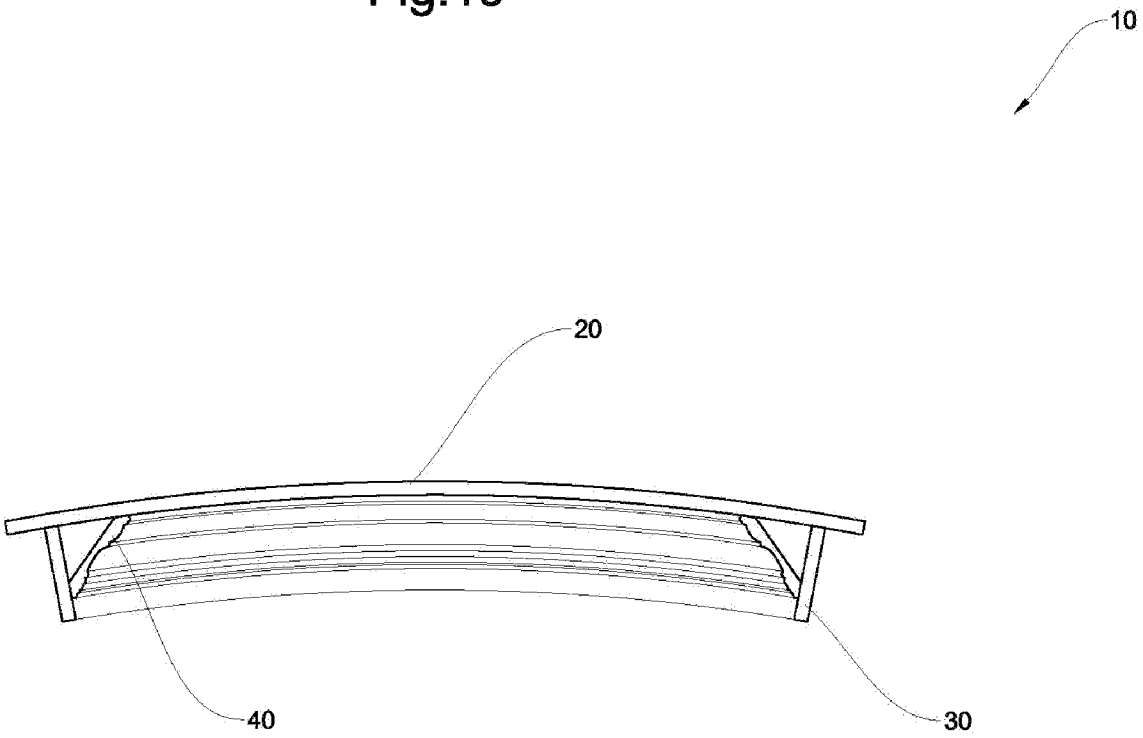

FIG. 19 is a cross-sectional view of the present system illustrating a single coffer module with an arched ceiling/surface panel with both arched and straight beam wall boards and beam board moldings.

Figure 20:
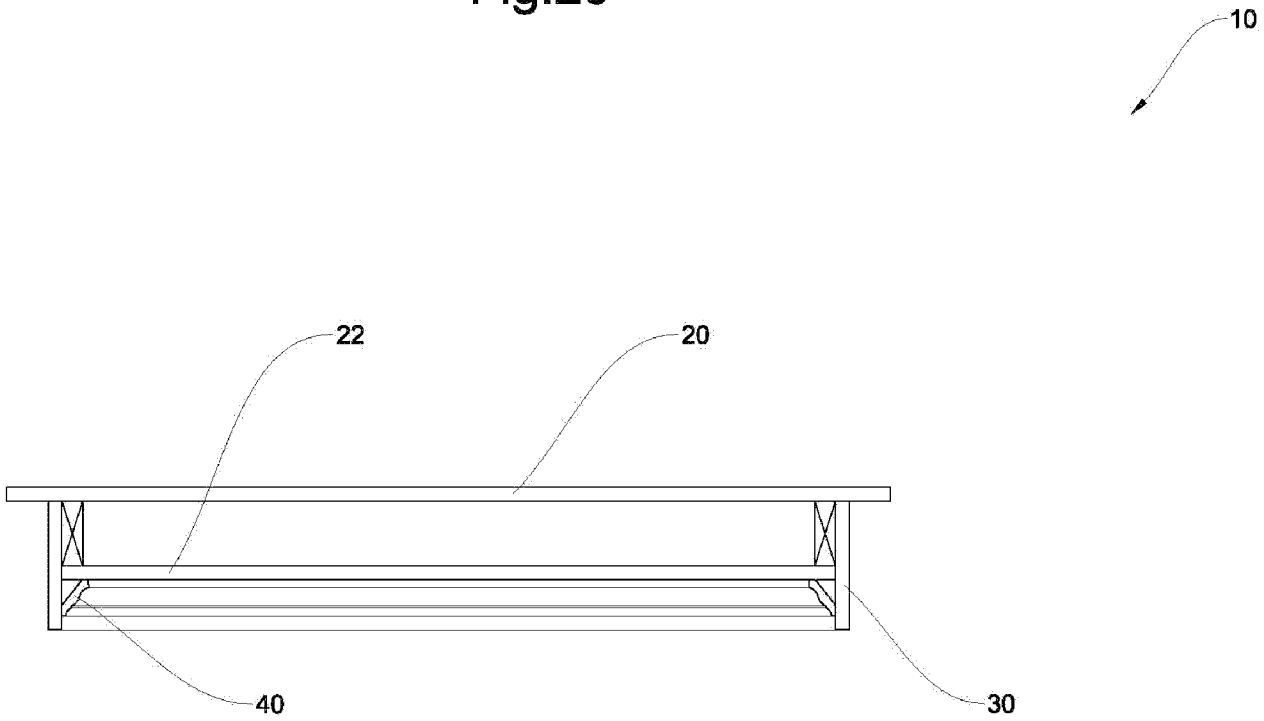

FIG. 20 is a cross-sectional view of the present system illustrating a single coffer module with a flat ceiling/surface panel with all straight beam wall boards and beam board moldings and a false or secondary non-integral ceiling panel.

Figure 21:
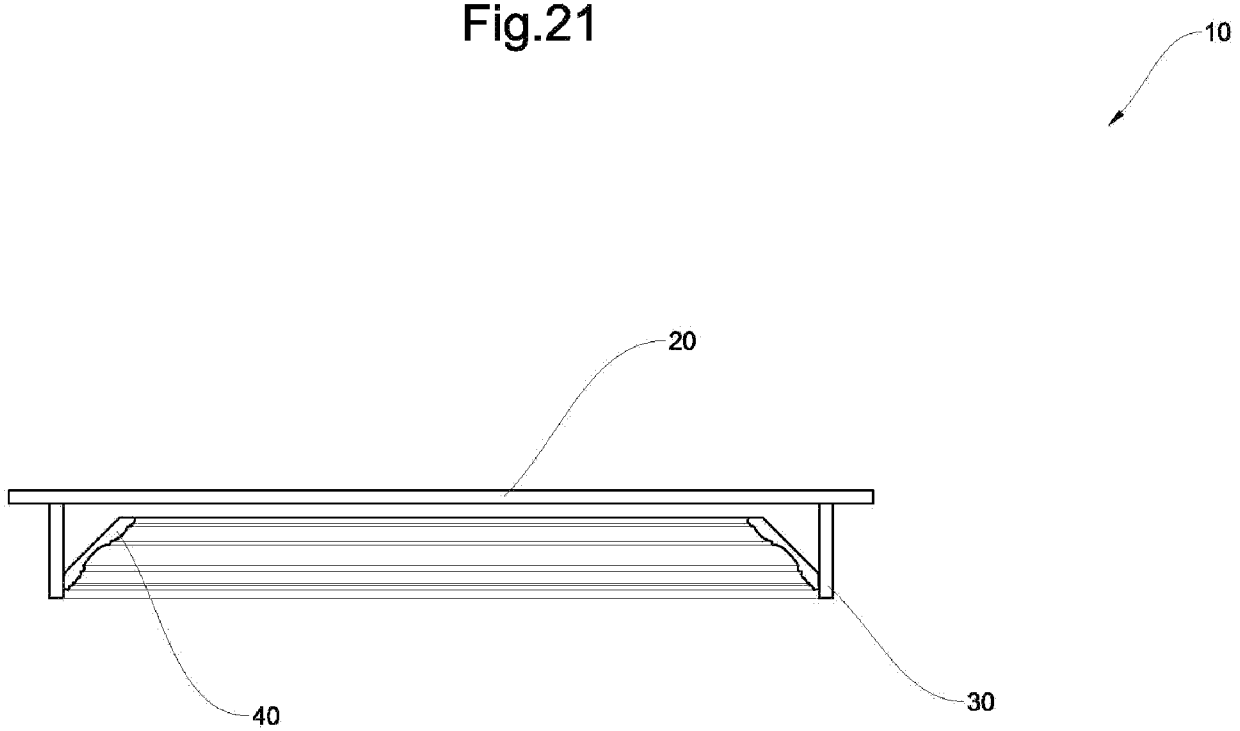

FIG. 21 is a cross-sectional view of the present system illustrating a single coffer module with a flat ceiling/surface panel with all straight beam wall boards and beam board moldings and showing the beam board molding as installed without it touching the ceiling/surface panel.

Figure 22:
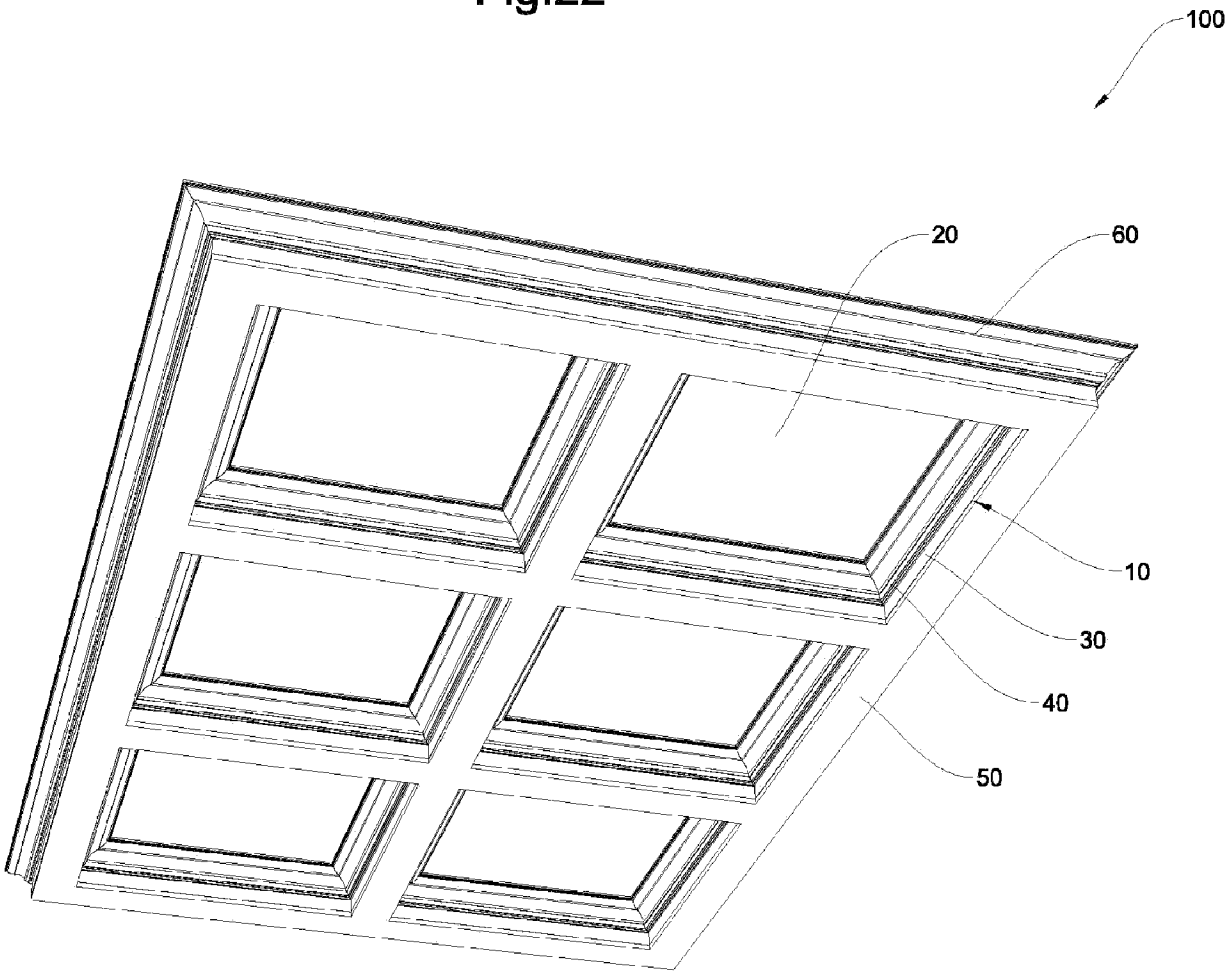

FIG. 22 is a perspective view of the present system illustrating a complete coffered ceiling system utilizing coffer modules with flat ceiling/surface panels with all square corners and all straight beam wall boards and beam board moldings on a flat surface as it terminates into the ceiling/surface it is mounted on.

Figure 23:
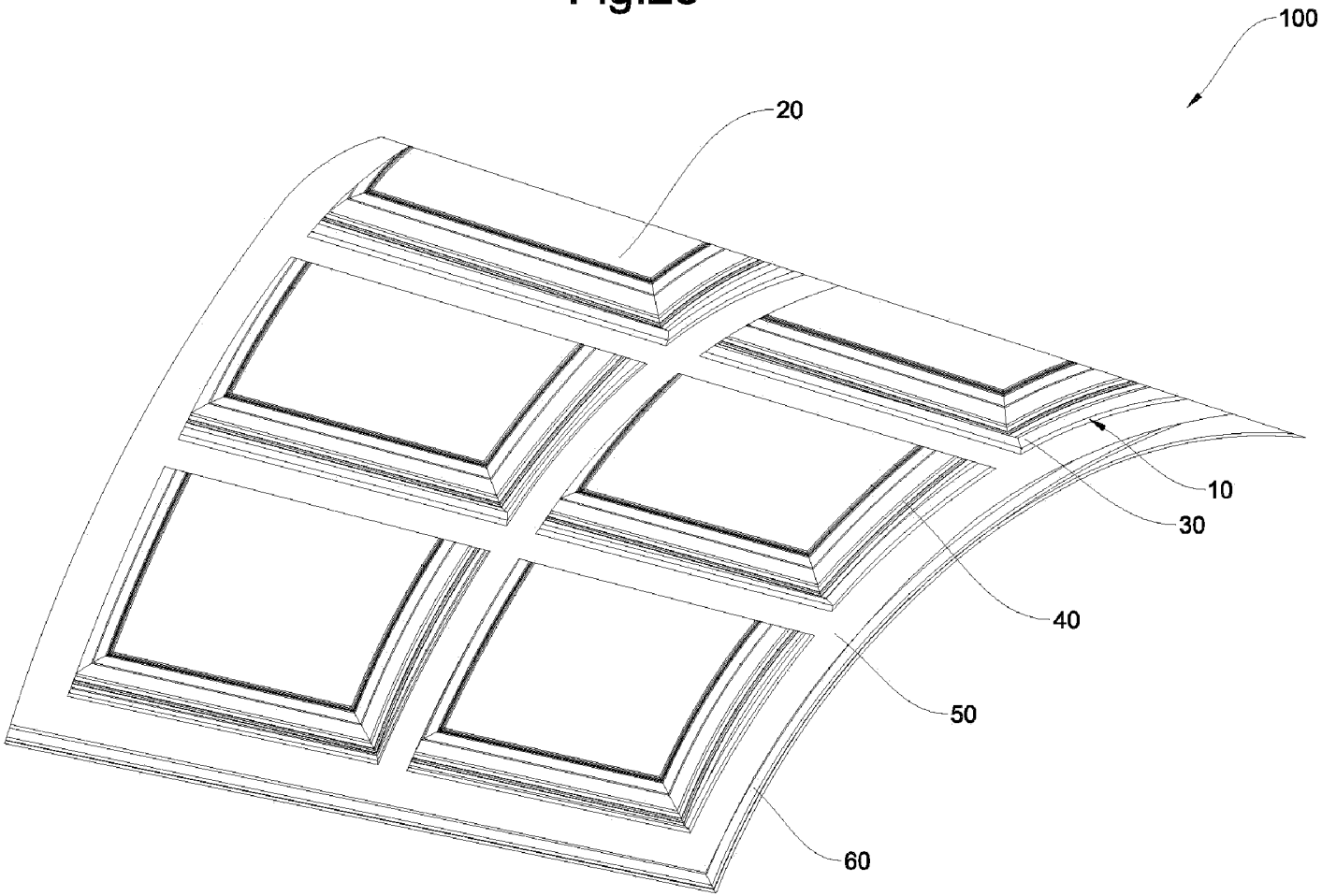

FIG. 23 is a perspective view of the present system illustrating a complete coffered ceiling system utilizing coffer modules with arched ceiling/surface panels with all square corners and with both straight and arched beam wall boards and beam board moldings on an arched ceiling/surface as it terminates into perpendicular walls/surfaces.

Figure 24:
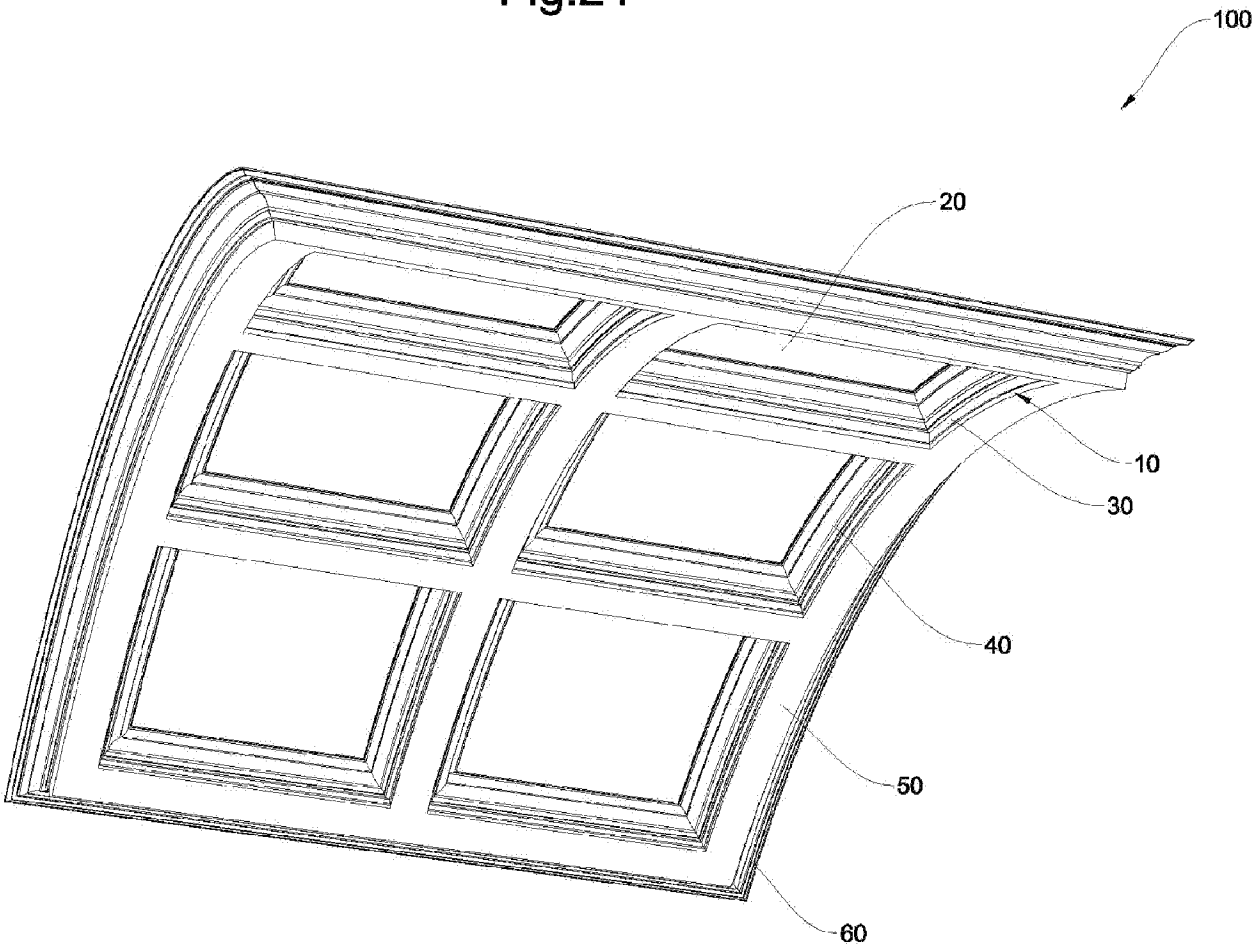

FIG. 24 is a perspective view of the present system illustrating a complete coffered ceiling system utilizing coffer modules with arched ceiling/surface panels with all square corners and with both straight and arched beam wall boards and beam board moldings on an arched ceiling/surface as it terminates into the ceiling/surface it is mounted on.

Figure 25:
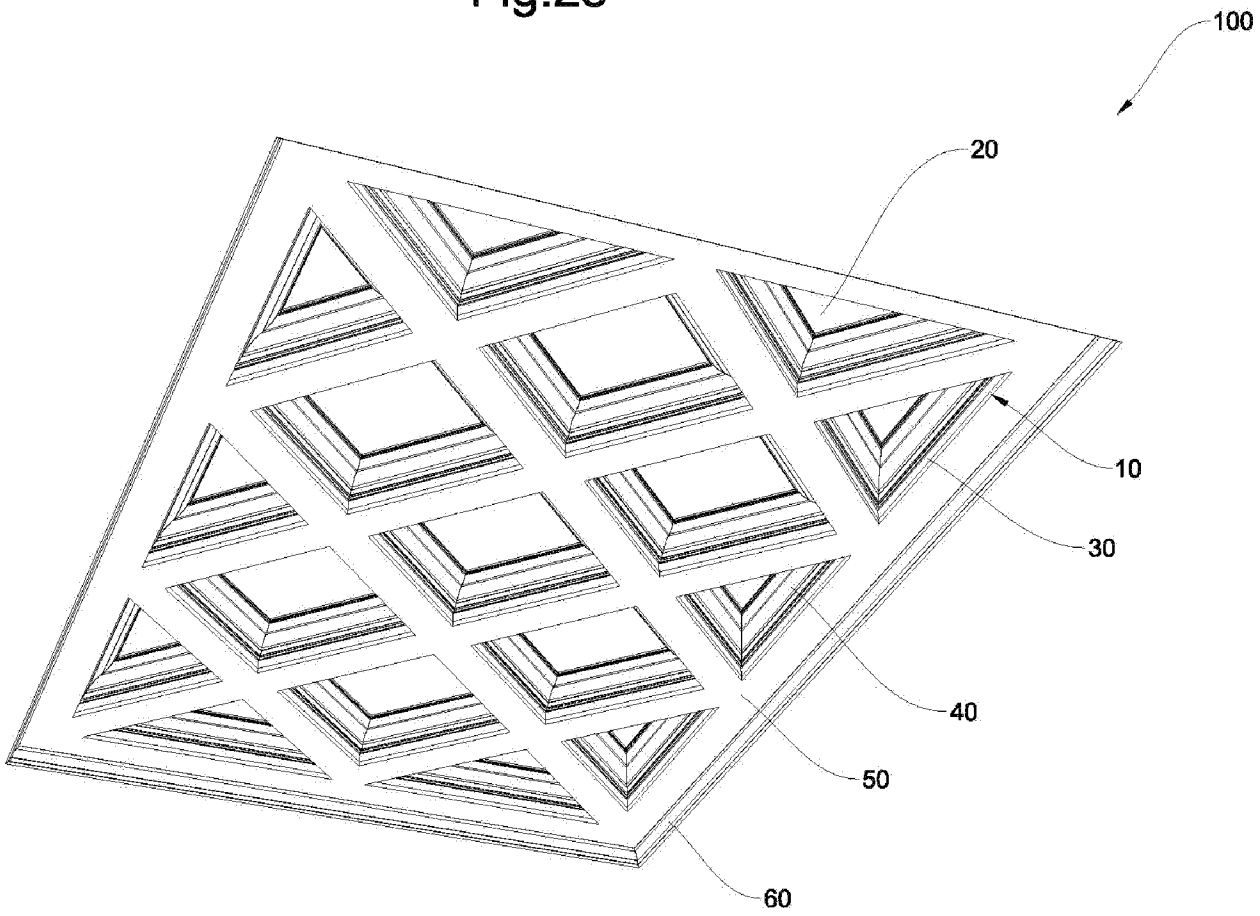

FIG. 25 is a perspective view of the present system illustrating a complete coffered ceiling system utilizing coffer modules with flat ceiling/surface panels with both square and angled corners with both straight and angled beam wall boards and beam board moldings with all of the inner beam assemblies set at an angle to the perimeter beam assemblies on a flat surface as it terminates into perpendicular walls/surfaces.

Figure 26:
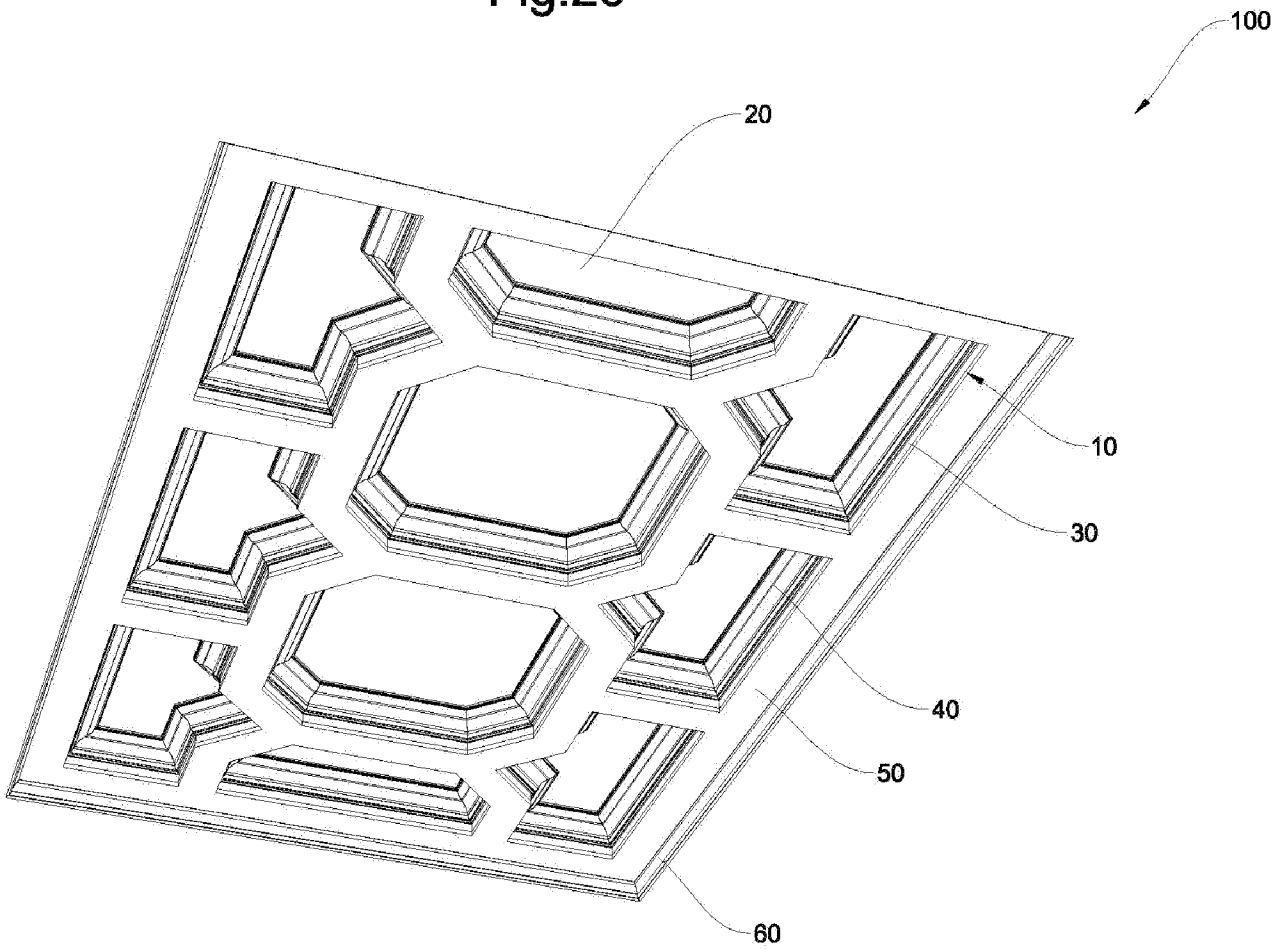

FIG. 26 is a perspective view of the present system illustrating a complete coffered ceiling system utilizing coffer modules with flat ceiling/surface panels with both square and angled corners with both straight and angled beam wall boards and beam board moldings with the inner beam assemblies set at both an angle to and parallel to the perimeter beam assemblies on a flat surface as it terminates into perpendicular walls/surfaces.

Figure 27:
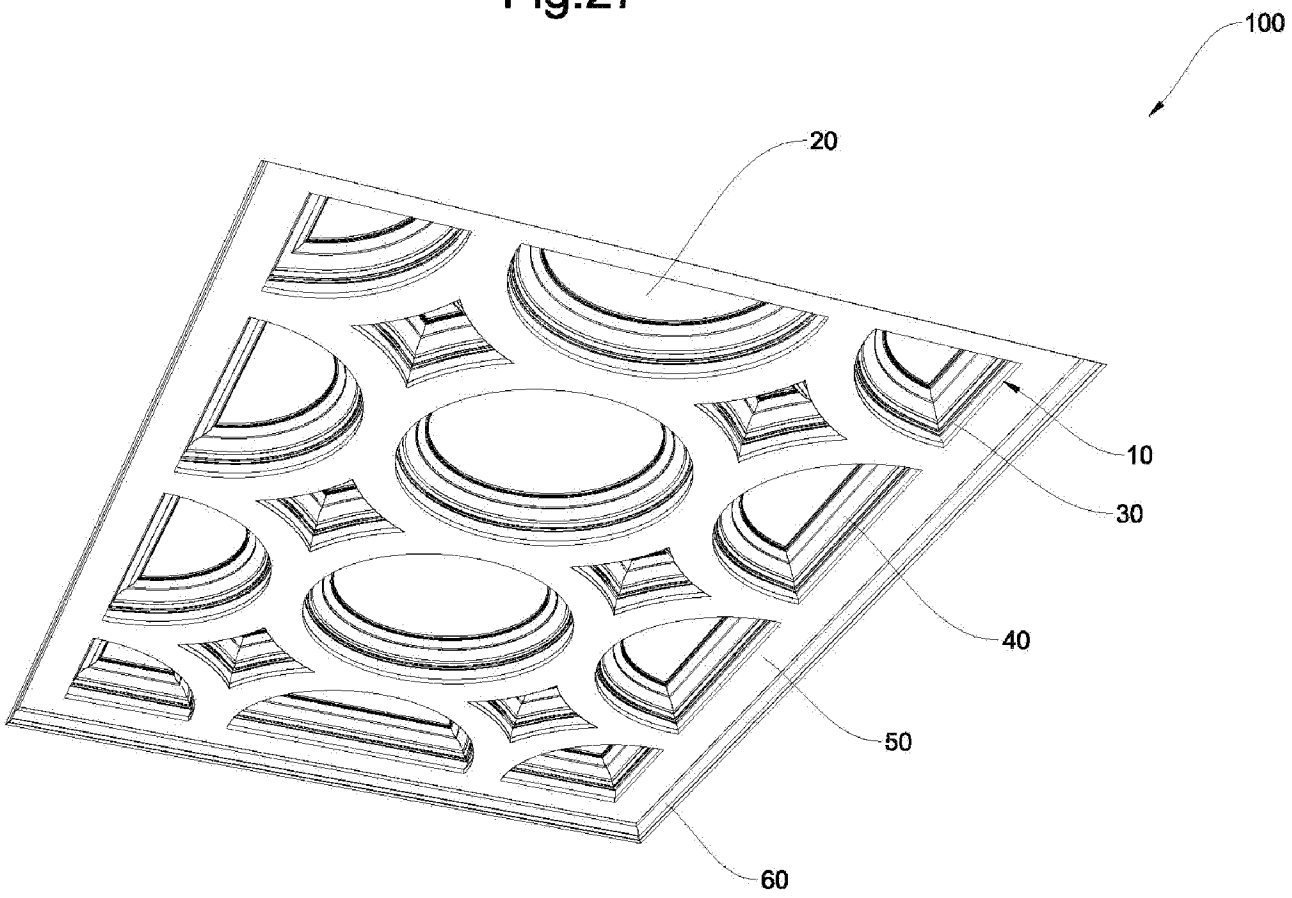

FIG. 27 is a perspective view of the present system illustrating a complete coffered ceiling system utilizing coffer modules with flat ceiling/surface panels with both square and radius corners with both straight and curved beam wall boards and beam board moldings with all of the inner beam assemblies set at a radius to the perimeter beam assemblies on a flat surface as it terminates into perpendicular walls/surfaces.

Figure 28:
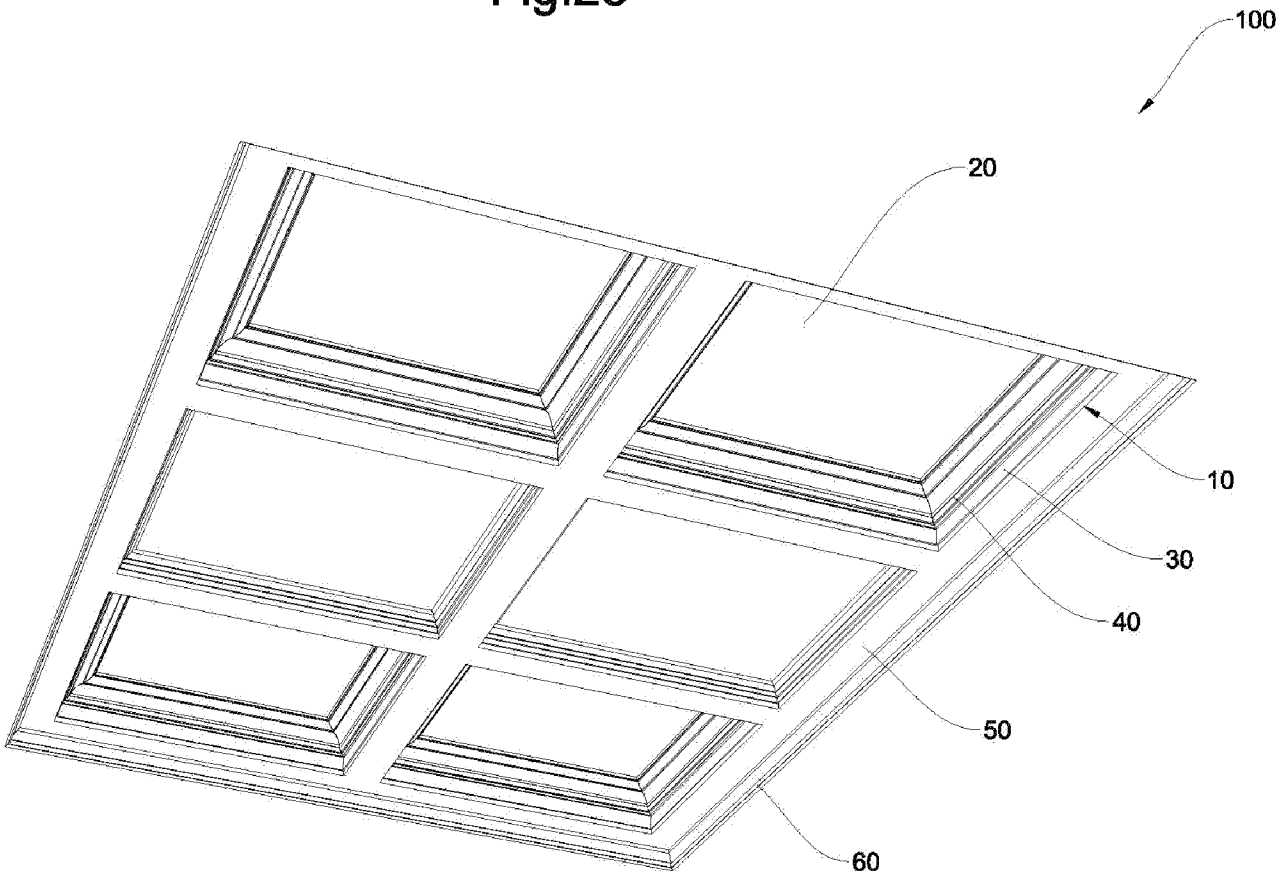

FIG. 28 is a perspective view of the present system illustrating a complete coffered ceiling system utilizing coffer modules with flat ceiling/surface panels with all square corners and all straight beam wall boards and beam board moldings with the two middle coffer modules having false or secondary, non-integral, flat ceiling/surface panels to make them appear shallower than the other four coffers on a flat surface as it terminates into the perpendicular walls/surfaces.

Figure 29:
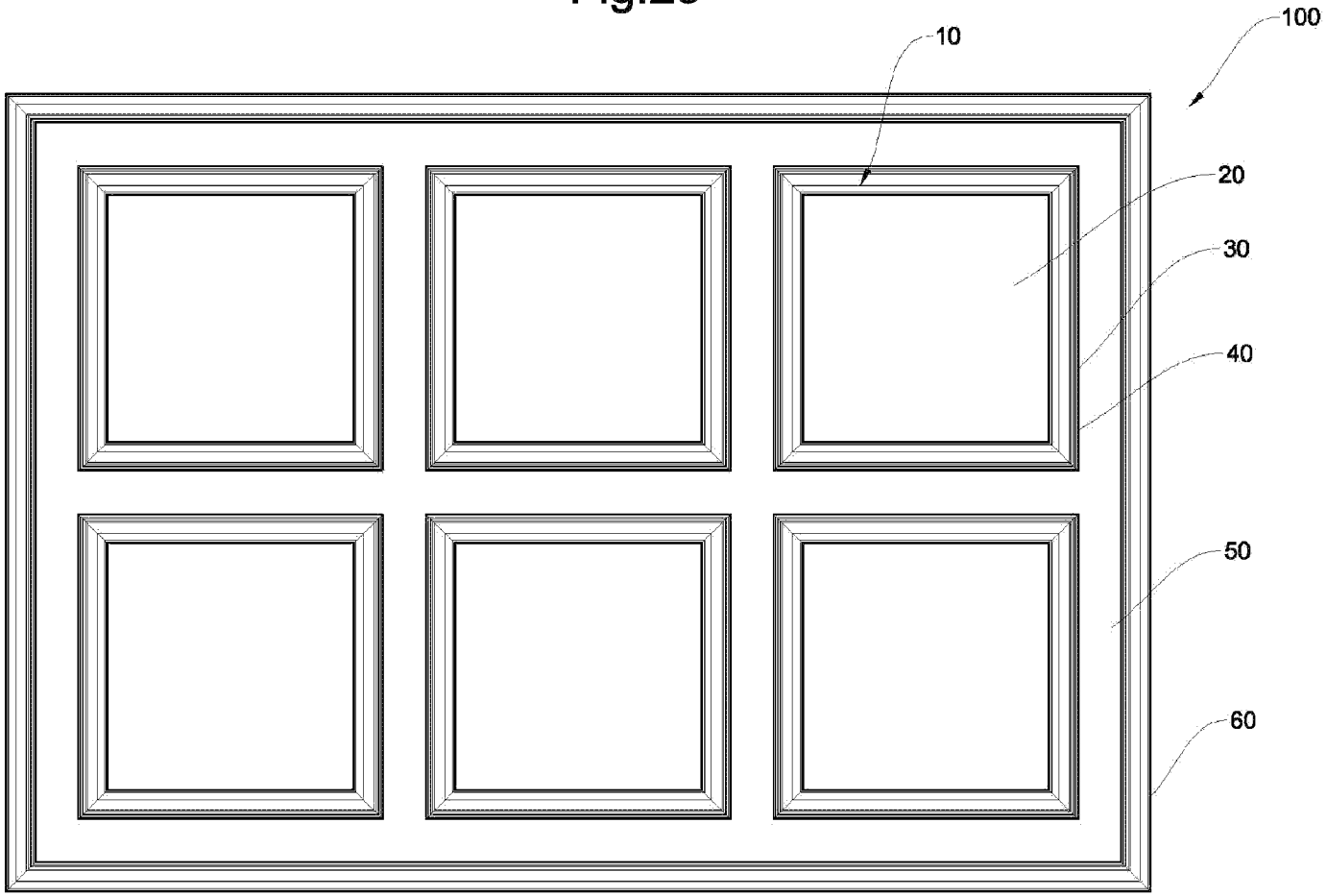

FIG. 29 is a plan view of the present system illustrating a complete coffered ceiling system utilizing coffer modules with flat ceiling/surface panels with all square corners and all straight beam wall boards and beam board moldings on a flat surface as it terminates into the ceiling/substrate surface it is mounted on.

Figure 30:
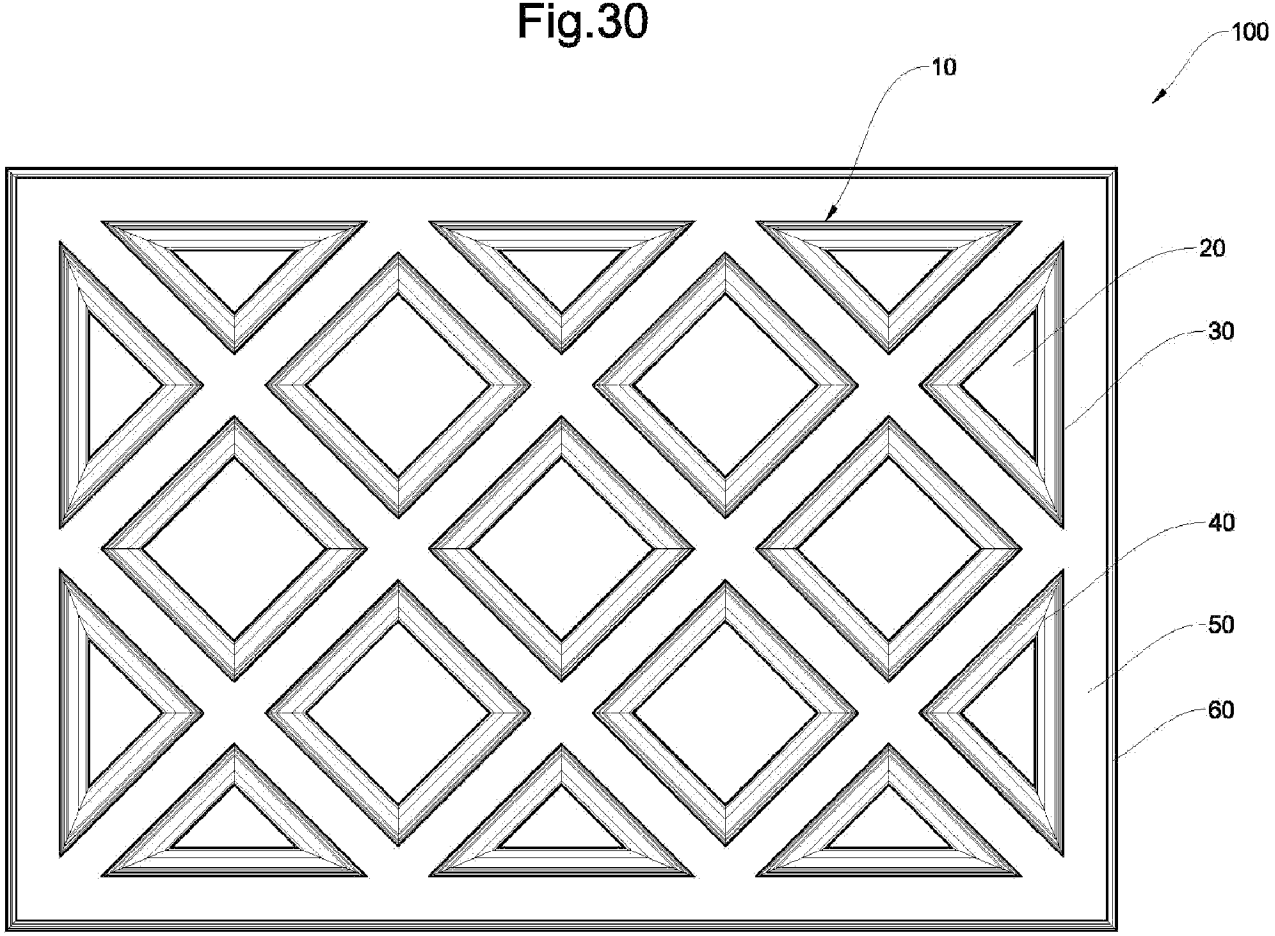

FIG. 30 is a plan view of the present system illustrating a complete coffered ceiling system utilizing coffer modules with flat ceiling/surface panels with both square and angled corners and with both straight and angled beam wall boards and beam board moldings with all inner beam assemblies set at an angle to the perimeter beam assemblies on a flat surface as it terminates into perpendicular walls/substrate surfaces.

Figure 31:
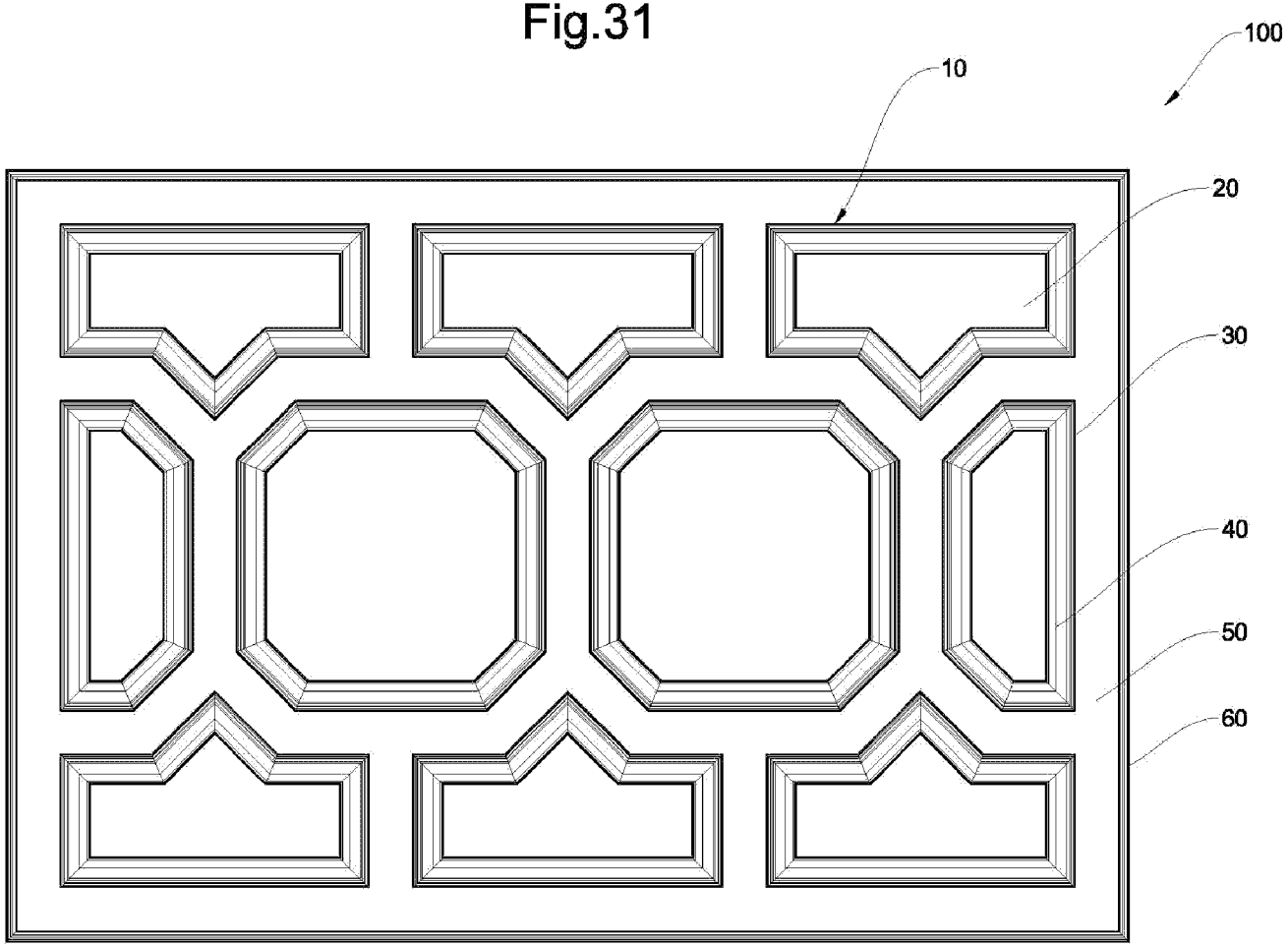

FIG. 31 is a plan view of the present system illustrating a complete coffered ceiling system utilizing coffer modules with flat ceiling/surface panels with both square and angled corners and both straight and angled beam wall boards and beam board moldings with the inner beam assemblies set at an angle to, perpendicular to, or parallel to the perimeter beam assemblies on a flat surface as it terminates into perpendicular walls/substrate surfaces.

Figure 32:
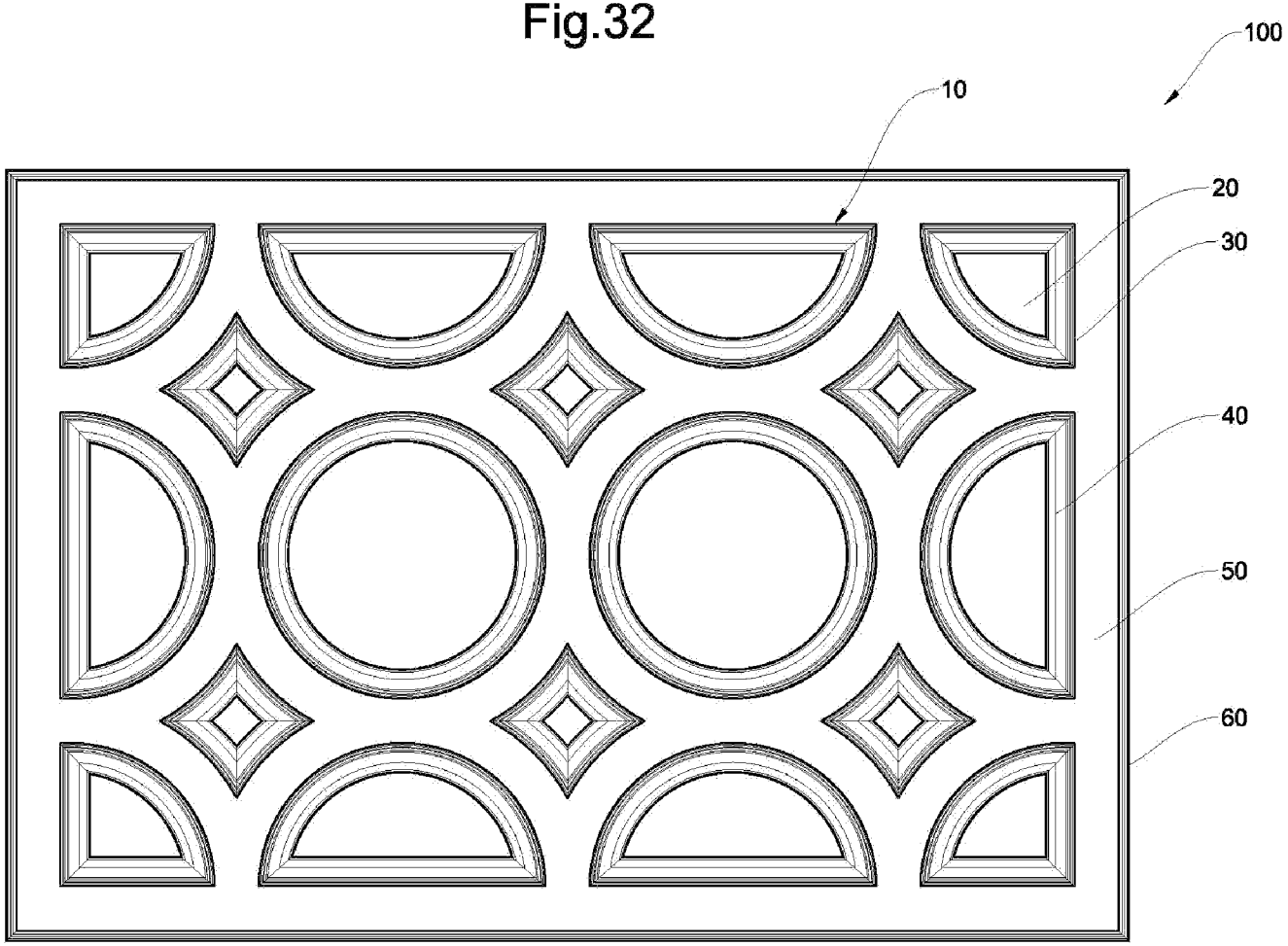

FIG. 32 is a plan view of the present system illustrating a complete coffered ceiling system utilizing coffer modules with flat ceiling/surface panels with both square and radius corners and both straight and curved beam wall boards and beam board moldings with all of the inner beam assemblies set at a curve to the perimeter beam assemblies on a flat surface as it terminates into perpendicular walls/substrate surfaces.

Figure 33:
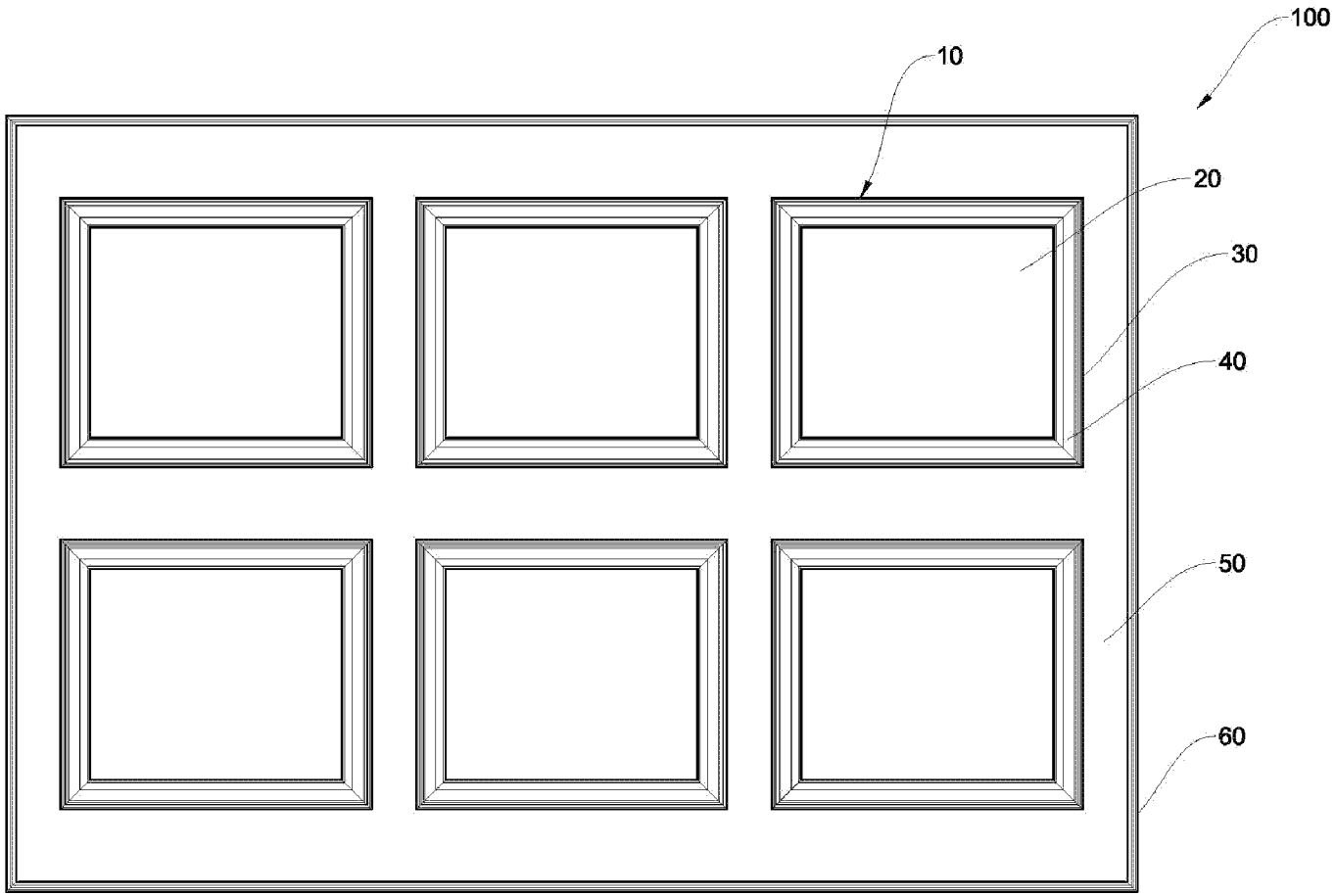

FIG. 33 is a plan view of the present system illustrating a complete coffered ceiling system utilizing coffer modules with flat ceiling/surface panels with all square corners and all straight beam wall boards and beam board moldings with beam bottom boards that vary in width on a flat surface as it terminates into perpendicular walls/substrate surfaces.

Figure 34:
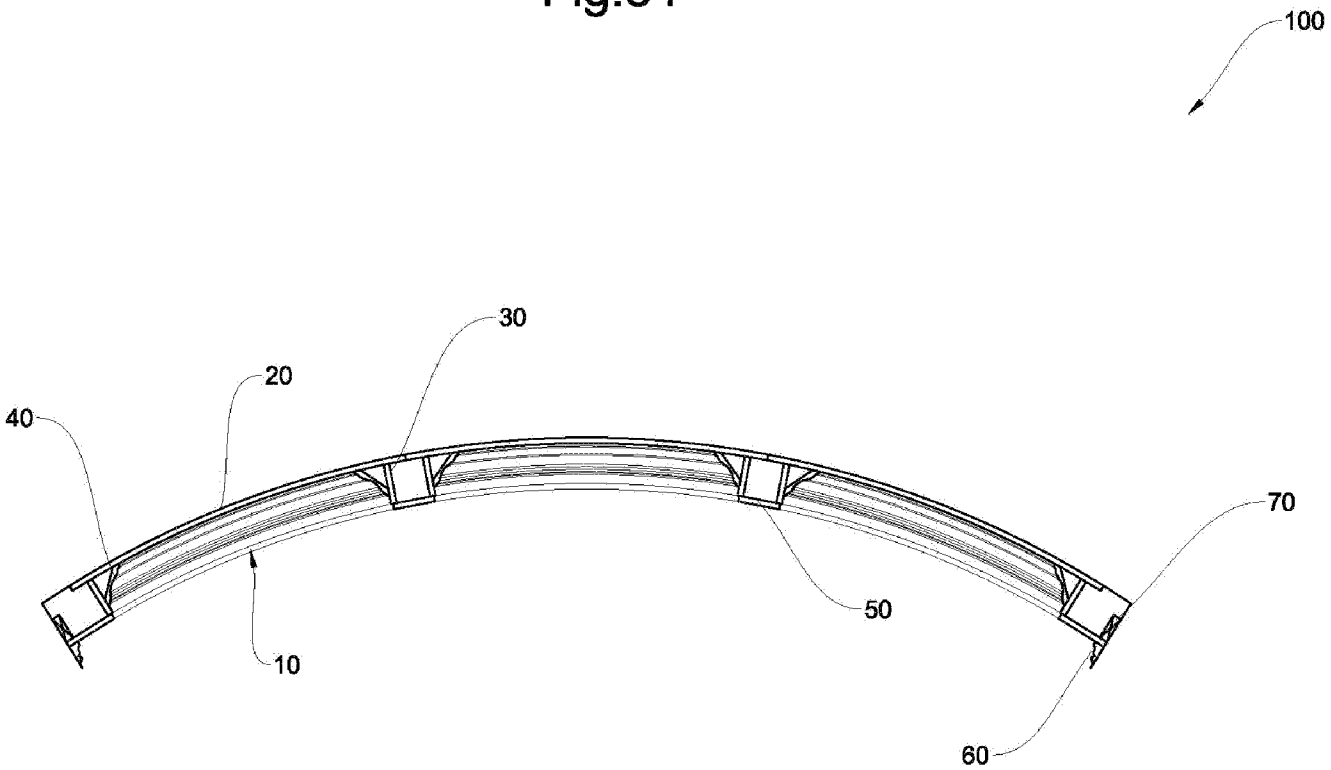

FIG. 34 is a cross-sectional view of the present system illustrating a complete coffered ceiling system utilizing coffer modules with arched ceiling/surface panels with all square corners and both straight and arched beam wall boards and beam board moldings on an arched ceiling/surface as it terminates into perpendicular walls/substrate surfaces.

Figure 35:
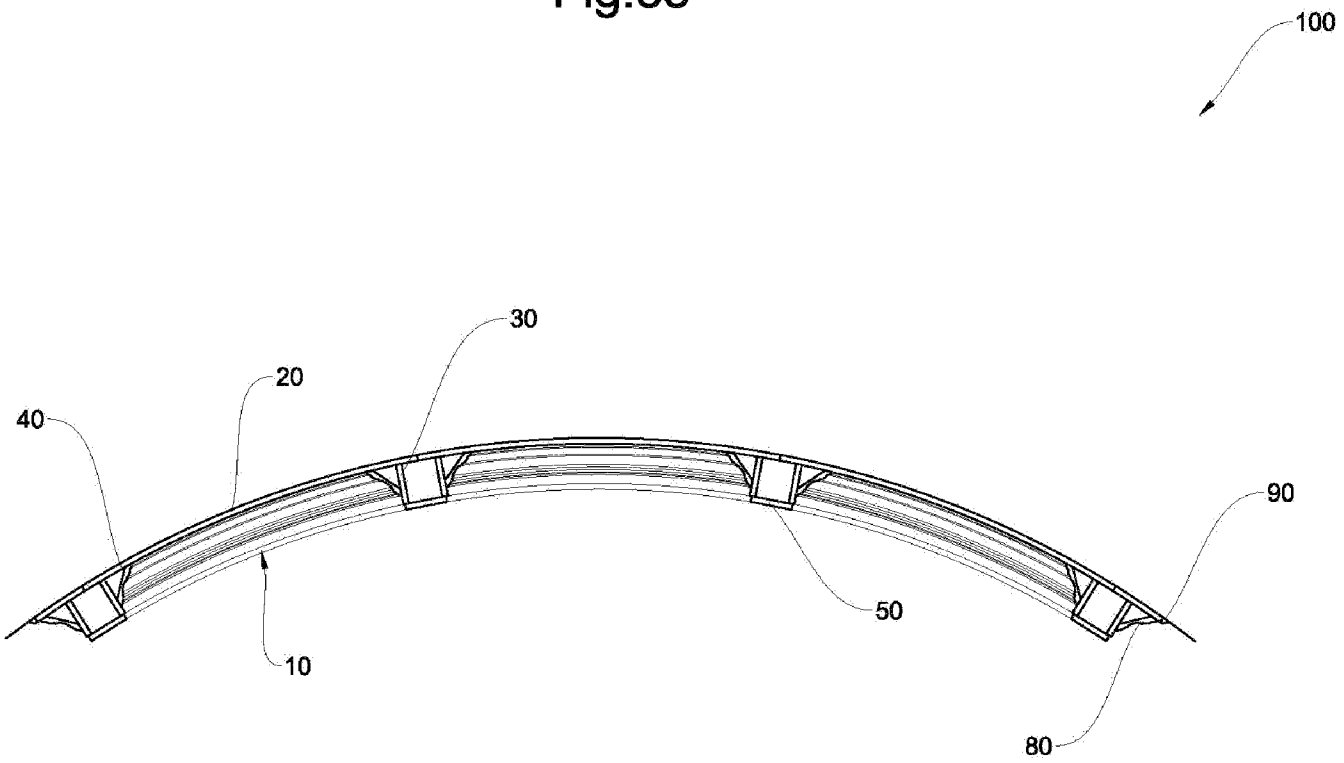

FIG. 35 is a cross-sectional view of the present system illustrating a complete coffered ceiling system utilizing coffer modules with arched ceiling/surface panels with all square corners and both straight and arched beam wall boards and beam board moldings on an arched ceiling/surface as it terminates into the ceiling/surface it is mounted on.

Figure 36:
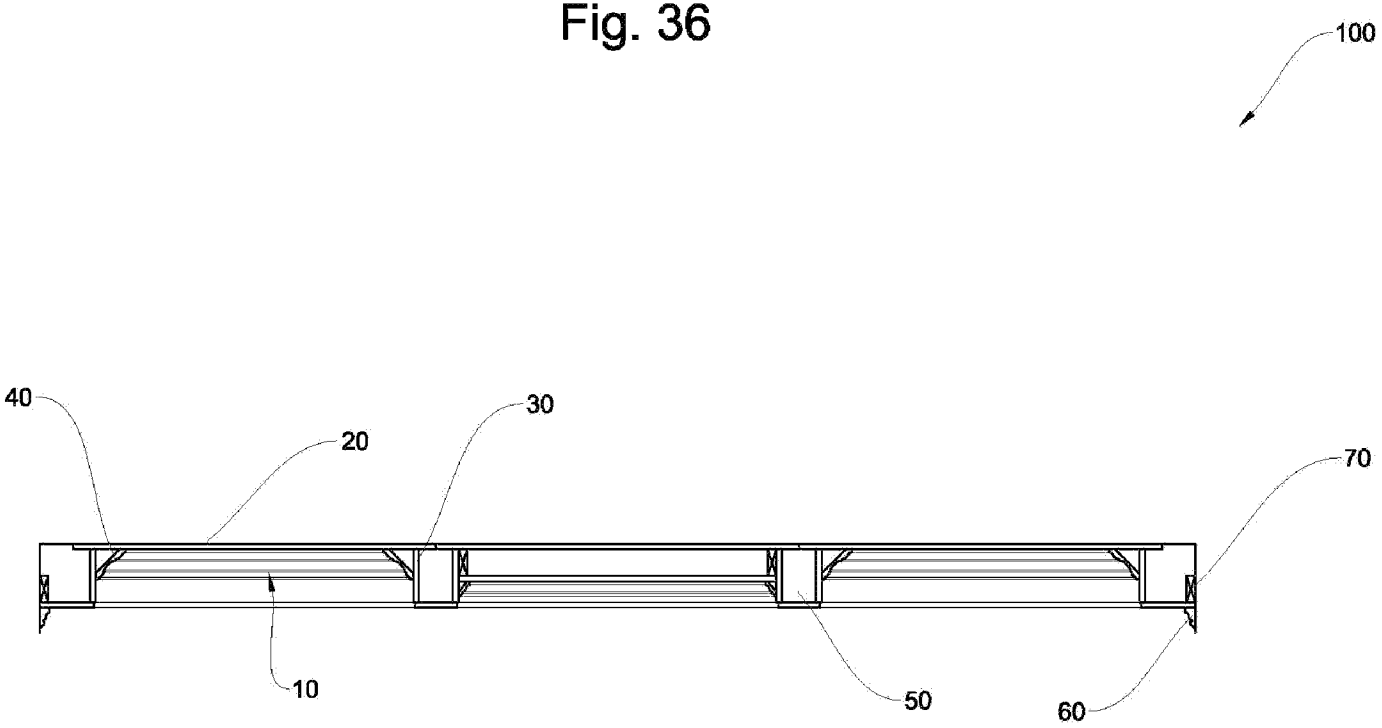

FIG. 36 is a cross-sectional view of the present system illustrating a complete coffered ceiling system utilizing coffer modules with flat ceiling/surface panels with all square corners and all straight beam wall boards and beam board moldings with one of the coffer modules having a false/secondary non-integral ceiling panel to make it appear shallower in depth than the other two modules on a flat surface as it terminates into the perpendicular walls/substrate surfaces.

Figure 37:
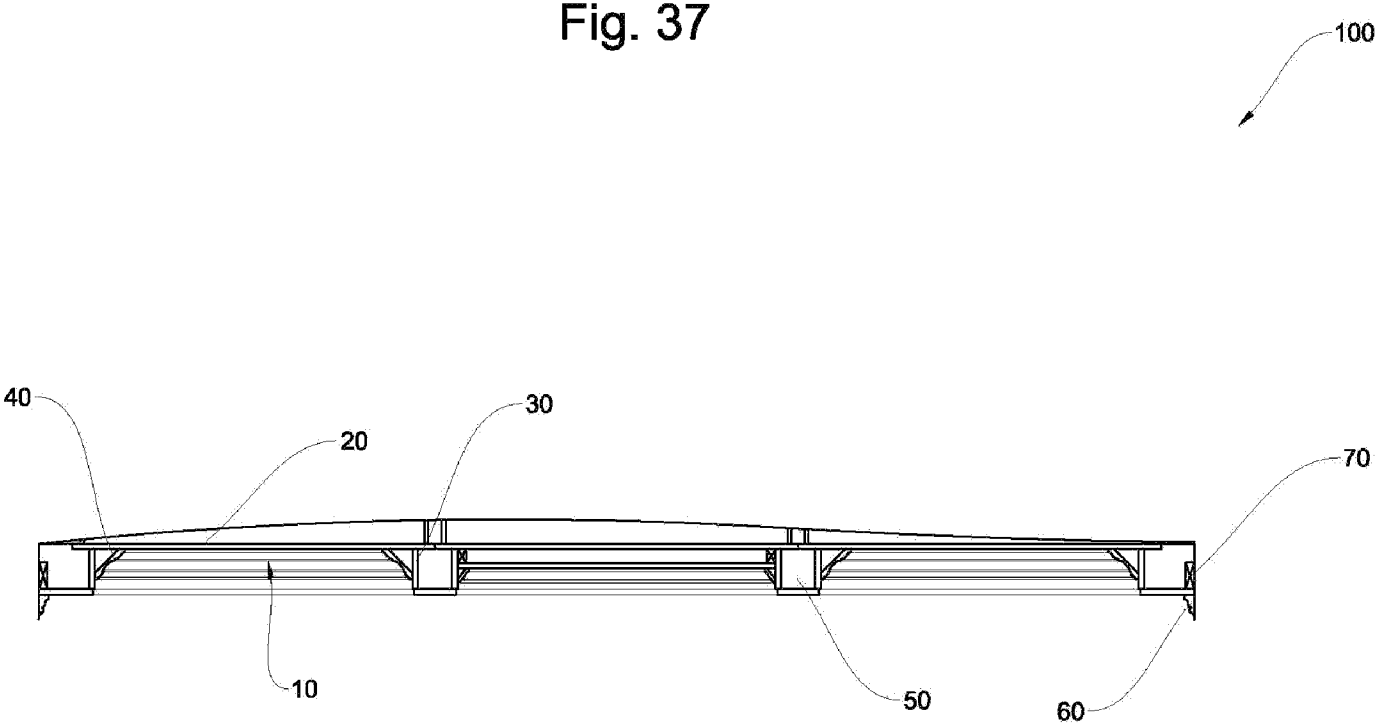

FIG. 37 is a cross-sectional view of the present system illustrating a complete coffered ceiling system utilizing coffer modules with flat ceiling/surface panels with all square corners and all straight beam wall boards and beam board moldings as installed on an unleveled, crooked, wavy or otherwise imperfect ceiling/surface with the variations in the ceiling/surface being overcome by the adjustment of mechanical fasteners in relation to the ceiling/surface.

Figure 38:
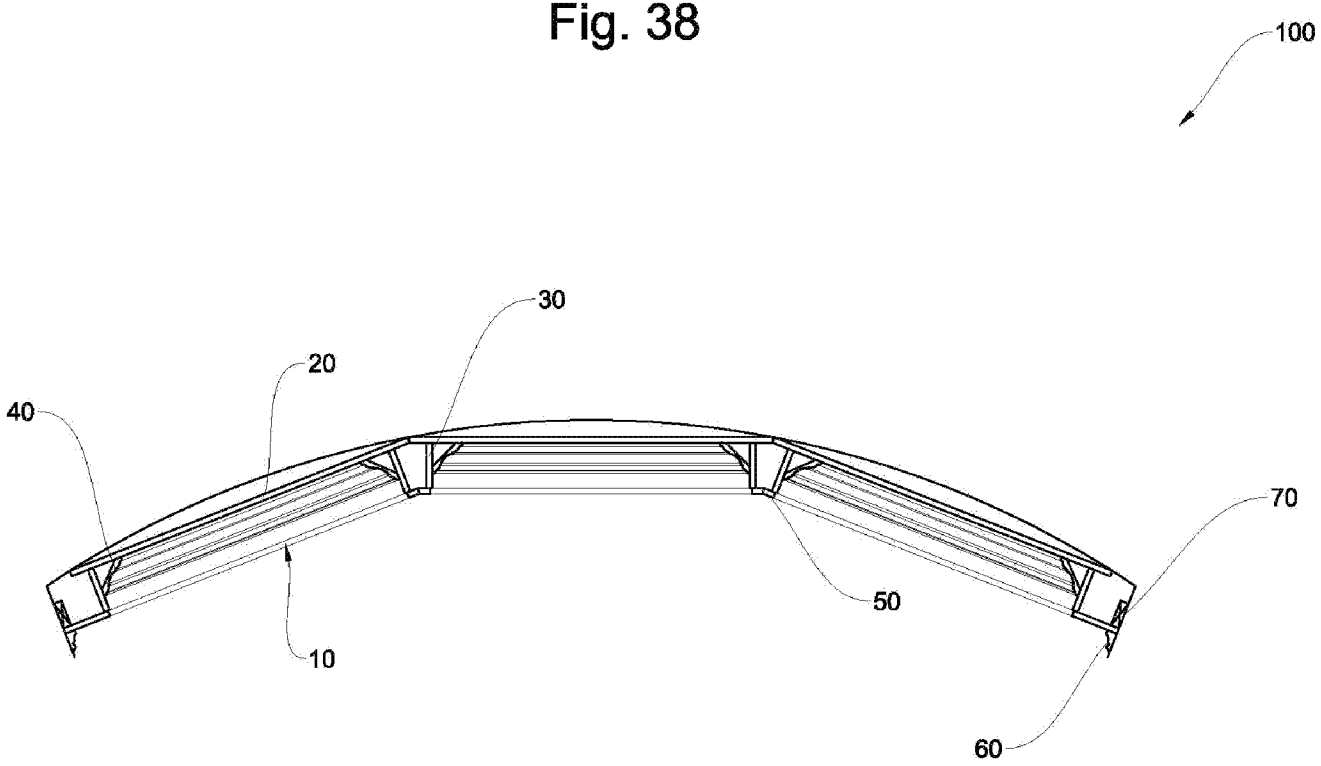

FIG. 38 is a cross-sectional view of the present system illustrating a complete coffered ceiling system utilizing coffer modules with flat ceiling/surface panels with all square corners and all straight beam wall boards and beam board moldings on an arched ceiling/surface as it terminates into perpendicular walls/substrate surfaces.

Figure 39:
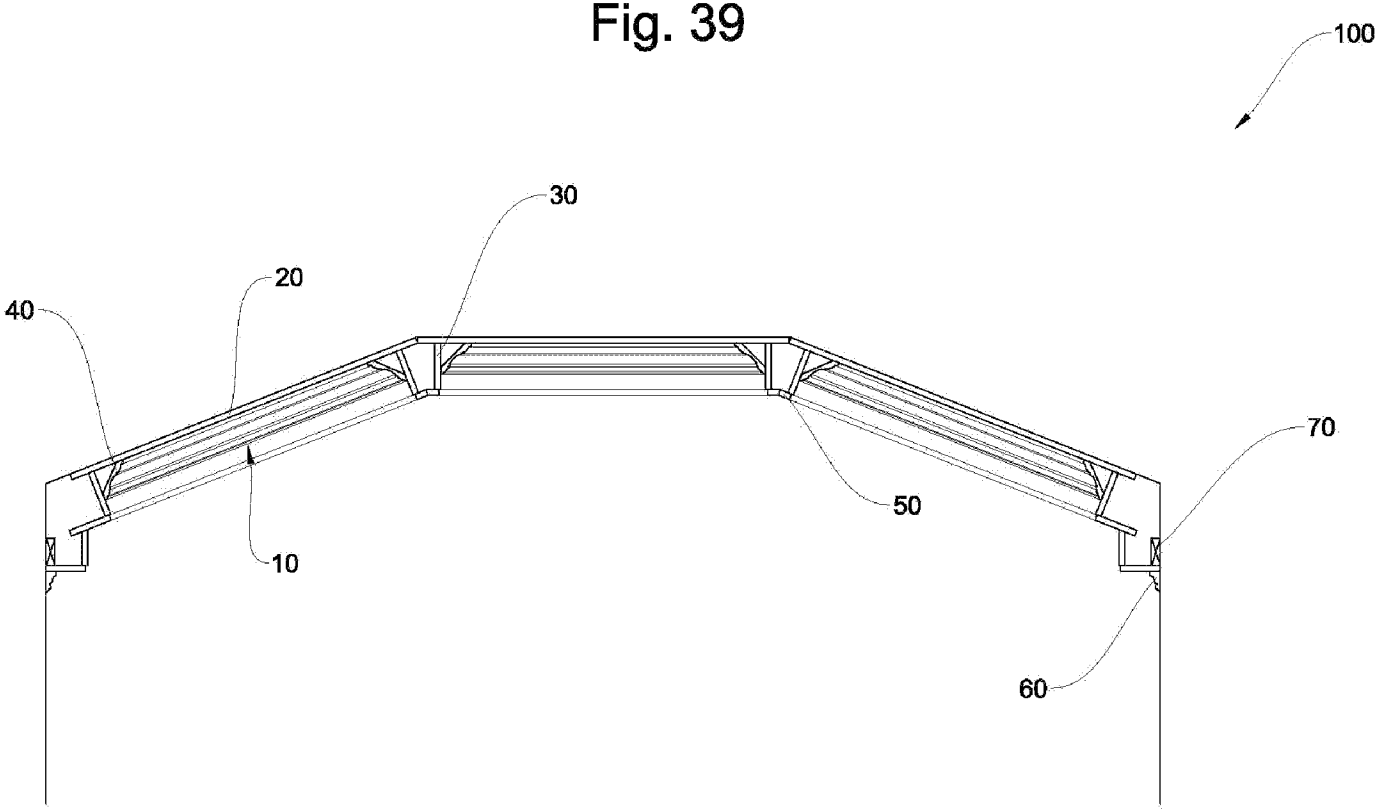

FIG. 39 is a cross-sectional view of the present system illustrating a complete coffered ceiling system utilizing coffer modules with flat ceiling/surface panels with all square corners and all straight beam wall boards and beam board moldings on a vaulted/angled ceiling/surface as it terminates into angled walls/substrate surfaces.

Figure 40:
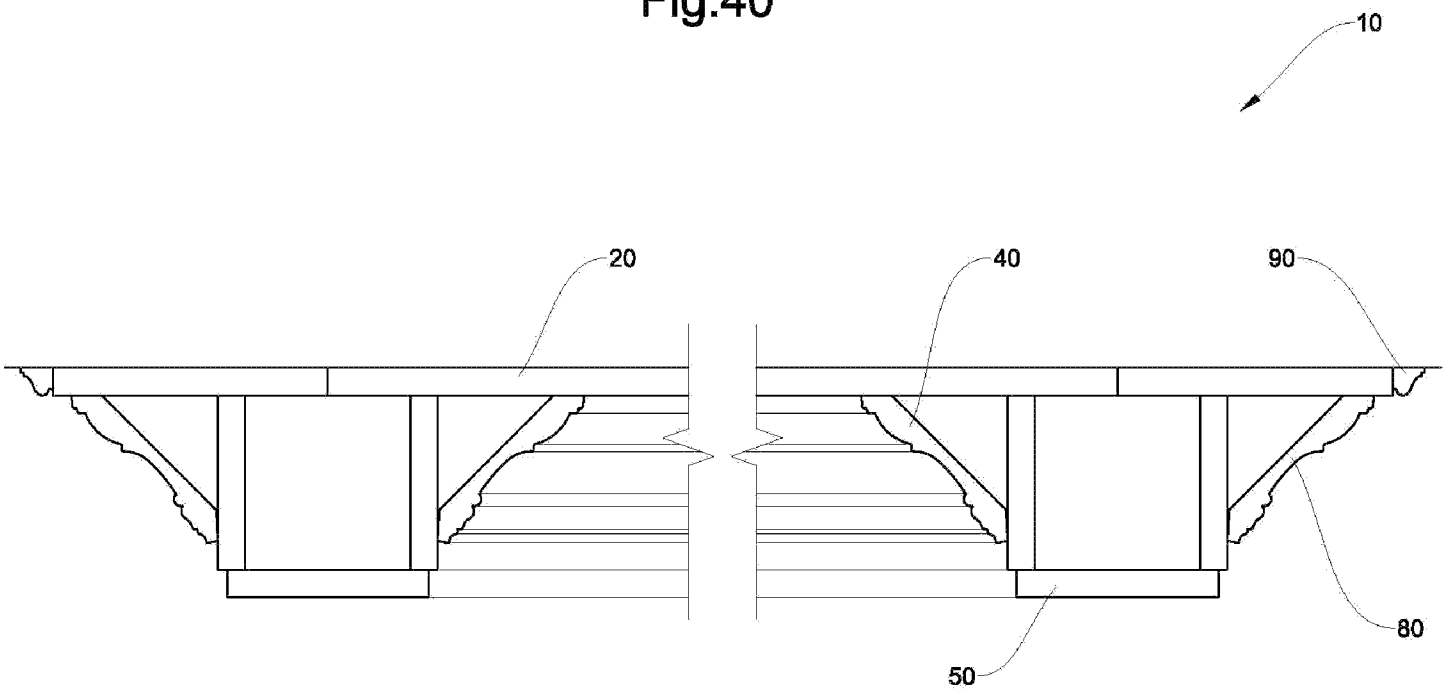

FIG. 40 is a blown-up cross-sectional view of the present system illustrating the perimeter beam assembly portions of a coffered ceiling system as they terminate into the ceiling/surface they are mounted on.

D. VARIATIONS

The spirit of the present system provides a breadth of scope that includes all methods of making and using it. Any variation on the theme and methodology of accomplishing the same that are not described herein would be considered under the scope of the present system.

What is claimed is:

1. A module, comprising:

a panel;

beam wall boards attached perpendicular to a first side of the panel and extending away from the panel and forming the side walls for a pattern of intersecting, non-structural hollow box beams, wherein the panel extends past the beam wall boards to create a fastening flange or point by which one or more additional modules are secured to a substrate; and a beam wall molding cut to size and custom-fitted to the beam wall boards and the panel after the beam wall boards have been attached to the panel, wherein the beam wall molding connects surfaces between the beam wall boards and the panel without covering beam wall board edges and wherein the panel directly terminates into a perpendicular wall or surface or into the substrate and wherein the module and resulting hollow box beams include polygonal and curved shapes and wherein the beam wall moldings follow the exact shape of the beam wall boards to eliminate spaces between the beam wall moldings and the beam wall board that would require filling by an additional board, part or component.

2. The module of claim 1, wherein the beam board molding connects the beam wall board and panel surfaces and provides structural support and reinforcement of the beam wall board and of the module as a whole.

3. The module of claim 1, comprising a nailer board or block to terminate the perimeter beam bottom boards and moldings to adjacent perpendicular walls or surfaces.

4. The module of claim 1, wherein the panel, beam wall boards, and beam wall moldings are custom-fitted to a given surface area.

5. The module of claim 1, wherein the panel, beam wall boards, and beam wall moldings are preassembled to form the module.

6. The module of claim 1, wherein the panel is selected from a group of styles consisting of: applied moldings, recessed/flat panel, raised panel and bead board panel.

7. The module of claim 1, comprising a joinery process that aligns and attaches the beam wall boards to the panel during preassembly.

8. The module of claim 1, wherein the module and other modules are completed by installing the beam board molding pieces one at a time in either clockwise or counter clockwise sequence inside of a completed panel and beam wall board assembly.

9. The module of claim 1, wherein the location of the coffer beam wall boards against the panel creates a flange that remains around the perimeter of the module for fastening and spacing of the module and additional modules during on-site installation.

10. The module of claim 9, wherein the coffered module components are fabricated with computer readable code for computer controlled fabrication equipment with user selectable options including: without preassembly and unfinished, without preassembly and prefinished, preassembled and unfinished, or preassembled and prefinished.

11. A system, comprising:

a plurality of modules, each with a coffer panel, coffer beam wall boards attached perpendicular to a first side of the panel and extending away from the panel and forming the side walls for a pattern of intersecting, non-structural hollow box beams, and coffer beam wall moldings, wherein each module includes a beam board molding that connects surfaces between the coffer beam wall boards and the coffer panel and wherein one or more of the panels directly terminates into the substrate and wherein the beam wall moldings follow the exact shape of the beam wall boards;

beam bottom boards positioned between the;

additional modules to complete a plurality of hollow box beams in an intersecting grid to replicate a desired look and feel of a structural elements, wherein the panel extends past the beam wall boards to create a fastening flange or point by which one or more additional modules are secured to a substrate; and perimeter moldings positioned between outer perimeter beam bottom boards and the adjacent perpendicular walls or surfaces.

12. The system of claim 11, comprising a nailer board or block to terminate the perimeter beam bottom boards and perimeter moldings into the adjacent perpendicular walls or surfaces.

13. The system of claim 11, wherein the panel, beam wall boards, and beam wall moldings are custom-fitted to a given surface area.

14. The system of claim 11, wherein the panel, beam wall boards, and beam wall moldings are preassembled to form individual modules.

15. The system of claim 11, wherein the panel is selected from a group of styles including smooth panel, applied molding panel, recessed/flat panel, raised panel or bead board panel.

16. The system of claim 11, comprising one or more perimeter beams that do not terminate at an adjacent perpendicular wall or surface.

17. The system of claim 16, wherein one or more perimeter beams terminate into the same substrate to which the additional modules are secured instead of terminating into an adjacent perpendicular wall or surface.

18. The system of claim 11, comprising one or more perimeter beams that do not terminate at an adjacent perpendicular wall or surface.

19. The system of claim 18, wherein one or more perimeter beams terminate into the same substrate to which the additional modules are secured instead of terminating into an adjacent perpendicular wall or surface.

* * * * *